US009363586B2

(12) United States Patent
Fincham

(10) Patent No.: US 9,363,586 B2
(45) **Date of Patent: *Jun. 7, 2016**

(54) NARROW PROFILE SPEAKER CONFIGURATIONS AND SYSTEMS

(71) Applicant: Lawrence R. Fincham, Santa Rosa, CA (US)

(72) Inventor: Lawrence R. Fincham, Santa Rosa, CA (US)

(73) Assignee: THX Ltd., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/798,006

(22) Filed: Mar. 12, 2013

(65) Prior Publication Data

US 2014/0105426 A1 Apr. 17, 2014

(51) Int. Cl.
*H04R 25/00* (2006.01)
*H04R 1/02* (2006.01)
(Continued)

(52) U.S. Cl.
CPC ..... *H04R 1/02* (2013.01); *H04S 1/002* (2013.01); *H04S 3/002* (2013.01); *H04R 2499/13* (2013.01)

(58) Field of Classification Search
CPC ..... H04R 1/02; H04R 1/021; H04R 1/023; H04R 1/025; H04R 1/026; H04R 1/20; H04R 1/22; H04R 1/24; H04R 1/26; H04R 1/30; H04R 1/34; H04R 1/225; H04R 1/227; H04R 1/342; H04R 1/345; H04R 1/2826; H04R 1/2842; H04R 1/2857; H04R 5/02; H04R 7/26; H04R 9/06; H04N 5/642; H04S 1/002
USPC ..... 381/160, 337, 339, 345, 347, 349; 181/179, 184, 185, 186, 199
See application file for complete search history.

(56) References Cited

U.S. PATENT DOCUMENTS 2,440,078 A 4/1948 Devine ..... 181/31
2,694,462 A 11/1954 Robbins et al.
(Continued)

FOREIGN PATENT DOCUMENTS

EP 0404 117 A2 12/1990
EP 0 744 880 11/1996
(Continued)

OTHER PUBLICATIONS

Lopez, Jose, et al., "3-D Audio With Dynamic Tracking for Multimedia Environtments," Universidad Politecnica de Valencia, Departamento de Comunicaciones, Grao de Gandia, Spain, 2nd COST-G6 Workshop on Digital Audio Effects (DAFx99), Dec. 9-11, 1999, Trondheim, Norway.
(Continued)

*Primary Examiner* — Brian Ensey
(74) *Attorney, Agent, or Firm* — Ben J. Yorks; Irell & Manella LLP

(57) ABSTRACT

A narrow profile speaker unit comprises at least one speaker outputting sound towards an internal surface and through a duct with an output terminus, such as a slot, having a narrow dimension, effectively changing the cross-section of the speaker's audio output wave. A pair of speakers may face one another, outputting sound towards a common output slot. Multiple pairs of speakers may be used to form an inline speaker unit for increased sound output. A slotted speaker unit may include multiple speakers facing the same direction, towards a groundplane or reflecting surface, and having parallel apertures for allowing sound radiation. The speaker units may be integral with or attached to electronic appliances such as desktop computers or flatscreen devices, or may be used in automobiles or other contexts.

37 Claims, 20 Drawing Sheets

(51) Int. Cl.

| | |
|---|---|
| ***H04S 1/00*** | (2006.01) |
| ***H04S 3/00*** | (2006.01) |

(56) References Cited

U.S. PATENT DOCUMENTS

| | | | | | |
|---|---|---|---|---|---|
| 3,371,742 | A | | 3/1968 | Norton et al. | 181/153 |
| 3,617,654 | A | | 11/1971 | Heidrich | 381/346 |
| 3,687,220 | A | | 8/1972 | Virva | |
| 4,016,953 | A | | 4/1977 | Butler | 381/89 |
| 4,029,170 | A | | 6/1977 | Phillips | 181/155 |
| 4,131,179 | A | | 12/1978 | Pope | 181/156 |
| 4,196,790 | A | | 4/1980 | Reams | |
| 4,308,423 | A | | 12/1981 | Cohen | 381/1 |
| 4,322,578 | A | | 3/1982 | Selmin | |
| 4,334,593 | A | | 6/1982 | Sechrist | 181/144 |
| 4,398,619 | A | | 8/1983 | Daniel | 181/156 |
| 4,474,258 | A | * | 10/1984 | Westlund | 181/199 |
| 4,509,184 | A | | 4/1985 | Yanagawa | 381/308 |
| 4,574,906 | A | | 3/1986 | White et al. | 381/348 |
| 4,620,317 | A | | 10/1986 | Anderson | 381/90 |
| 4,628,528 | A | | 12/1986 | Bose et al. | 381/90 |
| 4,748,669 | A | | 5/1988 | Klayman | 381/1 |
| 4,837,839 | A | | 6/1989 | Andrews | 381/199 |
| 4,846,382 | A | | 7/1989 | Foultner et al. | 224/42.42 |
| 4,866,774 | A | | 9/1989 | Klayman | 381/1 |
| 4,893,695 | A | | 1/1990 | Tamura et al. | |
| 5,036,946 | A | | 8/1991 | Yoshino | 181/156 |
| 5,043,970 | A | | 8/1991 | Holman | |
| 5,067,159 | A | | 11/1991 | Kasai et al. | 381/90 |
| 5,115,470 | A | | 5/1992 | Sutheim | 381/76 |
| 5,138,526 | A | | 8/1992 | Chung Hsiang | 361/392 |
| 5,199,075 | A | | 3/1993 | Fosgate | 381/24 |
| 5,225,639 | A | | 7/1993 | Kobayashi et al. | 181/151 |
| 5,227,591 | A | | 7/1993 | Tarkkonen | |
| 5,253,301 | A | | 10/1993 | Sakamoto et al. | 381/89 |
| 5,306,880 | A | | 4/1994 | Coziar et al. | 181/149 |
| 5,400,408 | A | | 3/1995 | Lundgren et al. | 381/88 |
| 5,432,860 | A | | 7/1995 | Kasajima et al. | 381/156 |
| 5,451,726 | A | | 9/1995 | Haugum | 181/150 |
| 5,471,018 | A | | 11/1995 | Nieuwendijk et al. | 181/152 |
| 5,517,574 | A | | 5/1996 | Tichy | |
| 5,561,717 | A | | 10/1996 | Lamm | 381/89 |
| 5,590,208 | A | | 12/1996 | Koyano et al. | 381/338 |
| 5,610,992 | A | | 3/1997 | Hickman | 381/188 |
| 5,657,391 | A | | 8/1997 | Jyosako | 381/1 |
| 5,661,808 | A | | 8/1997 | Klayman | 381/1 |
| 5,677,957 | A | | 10/1997 | Hulsebus | 381/1 |
| 5,727,066 | A | | 3/1998 | Elliott et al. | 381/1 |
| 5,749,433 | A | | 5/1998 | Jackson | 181/156 |
| 5,809,150 | A | | 9/1998 | Eberbach | 381/300 |
| 5,844,993 | A | | 12/1998 | Ilda et al. | 381/18 |
| 5,862,227 | A | | 1/1999 | Orduna-Bustamante et al. | 381/17 |
| 5,870,484 | A | | 2/1999 | Greenberger | 381/300 |
| 5,870,485 | A | | 2/1999 | Lundgren et al. | 381/306 |
| 5,902,023 | A | | 5/1999 | Yu et al. | 312/7.2 |
| 5,929,393 | A | | 7/1999 | Jeter, Jr. | 181/199 |
| 5,930,376 | A | | 7/1999 | Markow et al. | 381/333 |
| 5,943,431 | A | | 8/1999 | Weiss et al. | 381/305 |
| 5,949,894 | A | | 9/1999 | Nelson et al. | 381/300 |
| 6,198,826 | B1 | | 3/2001 | Cowieson et al. | 381/18 |
| 6,243,476 | B1 | | 6/2001 | Gardner | 381/303 |
| 6,292,570 | B1 | | 9/2001 | Aarts | 381/18 |
| 6,363,157 | B1 | | 3/2002 | Chick | 381/89 |
| 6,415,035 | B1 | | 7/2002 | Shin et al. | |
| 6,721,425 | B1 | | 4/2004 | Aylward | 381/22 |
| 6,739,424 | B2 | | 5/2004 | Ogura et al. | |
| 6,771,787 | B1 | | 8/2004 | Hoefler et al. | 381/338 |
| 6,798,891 | B1 | | 9/2004 | Sadaie et al. | |
| 6,804,358 | B1 | | 10/2004 | Kawano | 381/17 |
| 7,010,138 | B1 | | 3/2006 | Harris et al. | |
| 7,013,013 | B2 | | 3/2006 | Takei | 381/307 |
| 7,177,431 | B2 | | 2/2007 | Davis et al. | 381/1 |
| 7,254,239 | B2 | | 8/2007 | Fincham | 381/17 |
| 7,316,290 | B2 | | 1/2008 | Hutt et al. | |
| 7,433,483 | B2 | | 10/2008 | Fincham | 381/337 |
| 7,457,425 | B2 | | 11/2008 | Fincham | 381/302 |
| 7,463,746 | B2 | | 12/2008 | Caron et al. | 381/345 |
| 7,593,533 | B2 | | 9/2009 | Fincham | 381/17 |
| 7,974,425 | B2 | | 7/2011 | Fincham | |
| 8,027,500 | B2 | | 9/2011 | Fincham | 381/337 |
| 8,457,340 | B2 | | 6/2013 | Fincham | |
| 2002/0153193 | A1 | | 10/2002 | Toki | 181/148 |
| 2002/0154783 | A1 | | 10/2002 | Fincham | 381/17 |
| 2003/0219137 | A1 | | 11/2003 | Fincham | 381/302 |
| 2005/0129258 | A1 | | 6/2005 | Fincham | 381/352 |
| 2005/0281409 | A1 | | 12/2005 | Sakane et al. | 381/18 |
| 2006/0210087 | A1 | | 9/2006 | Davis et al. | 381/17 |

FOREIGN PATENT DOCUMENTS

| | | | |
|---|---|---|---|
| GB | 2 074 823 A | 11/1981 | |
| GB | 2 184 323 | 6/1987 | |
| GB | 2284125 A | 5/1995 | H04R 1/40 |
| JP | 52-004202 | 1/1977 | H04R 5/00 |
| JP | 56-016400 | 2/1981 | H04S 1/00 |
| JP | 56-162600 | 12/1981 | H04S 1/00 |
| JP | 58-50781 | 4/1983 | |
| JP | 63-502945 | 10/1988 | H04S 1/00 |
| JP | 64-018396 | 1/1989 | H04R 1/28 |
| JP | 04-137994 | 5/1992 | H04R 1/20 |
| JP | 05-014993 | 1/1993 | H04R 5/02 |
| JP | 08-154300 | 6/1996 | H04S 1/00 |
| JP | 11-252698 | 9/1999 | H04S 1/00 |
| JP | 11-318000 | 11/1999 | |
| JP | 2000-078700 | 3/2000 | H04S 5/02 |
| WO | WO 87/06090 | 10/1987 | H04S 1/00 |
| WO | WO 94/01981 | 1/1994 | |
| WO | WO 00/25618 | 5/2000 | |
| WO | 00 52958 | 9/2000 | |
| WO | WO 00/67522 | 11/2000 | |

OTHER PUBLICATIONS

Brown, C. Phillip, et al., "A Structural Model for Binaural Sound Synthesis," IEEE Transactions on Speech and Audio Processing, vol. 6, No. 5, Sep. 1998.

Jost, Adrian, et al., "Transaural 3-D With User-Controlled Calibration," Proceedings of the COST G-6 Conference on Digital Audio Effects (DAFX-00), Verona, Italy, Dec. 7-9, 2000.

Jot, Jean-Marc, "Synthesizing Three-Dimensional Sound Scenes in Audio or Multimedia Production and Interactive Human-Computer Interfaces," 5$^{th}$ International Conference: Interface to Real & Virtual Worlds, Montpellier, France, May 1996.

Kyriakakis, Chris, "Fundamental and Technological Limitations of Immersive Audio Systems," Proceedings of the IEEE, vol. 86, No. 5, May 1998.

Kendall, Gary S., "A 3D Sound Primer," Center for Music Technology, School of Music, Northwestern University, printout from website (www.northwestern.edu/musicschool/classes/3D/pages/sndPrmGK.html), printed Jan. 4, 2002.

Soebo, Asbjorn, "Effect of Early Reflections in Binaural Systems With Loudspeaker Reproduction," Acoustics Group, Department of Telecommunications, Norwegian University of Science and Technology (NTNU), Proc. 1999 IEEE Workshop on Applications of Signal Processing to Audio and Acoustics, New Paltz, New York, Oct. 17-20, 1999.

Zurek, P.M., "The Precedence Effect," *Directional Hearing*, Springer-Verlag, New York, 1987, pp. 85-105.

Trahiotis, Bernstein, "Some Modern Techniques and Devices Used to Preserve and Enhance the Spatial Qualities of Sound," *Directional Hearing*, Springer-Verlag, New York, 1987, pp. 279-290.

"Virtual Acoustics Project," Institute of Sound and Vibration Research, University of Southampton, printout from website (www.isvr.soton.ac.uk/FDAG/vap/), Feb. 4, 1998.

Kahana, et al, "Multi-Channel Sound Reproduction using a Four-Ear Dummy-Head," presented at the 102$^{nd}$ Audio Engineering Society Convention, Mar. 22-25, 1997, Munich, Germany.

Kahana, et al, "Objective and Subjective Assessment of Systems for the Production of Virtual Acoustic Images for Multiple Listeners," presented at the 102$^{nd}$ Audio Engineering Society Convention, Mar. 22-25, 1997, Munich, Germany.

(56) References Cited

OTHER PUBLICATIONS

Kahana, et al, "A Multiple Microphone Recording Technique for the Generation of Virtual Acoustic Images," Journal of the Acoustical Society of America, vol. 105, No. 3, Mar. 1999, pp. 1503-1516.
Kirkeby, et al, "Local Sound Field Reproduction using Digital Signal Processing," Journal of the Acoustical Society of America, vol. 100, No. 3, Sep. 1996, pp. 1584-1593.
Kirkeby, et al, "Virtual Source Imaging Over Loudspeakers," Proceedings of the Institute of Acoustics, vol. 19: Part 6, 1997.
Kirkeby, et al, "The 'Stereo Dipole': Binaural Sound Reproduction using Two Closely Spaced Loudspeakers," presented at the 102$^{nd}$ Audio Engineering Society Convention, Mar. 22-25, 1997, Munich, Germany.
Kirkeby, et al, "Acoustic Fields Generated by Virtual Source Imaging Systems," Proceedings of Active 97, The 1997 International Symposium on Active Control of Sound and Vibration, Aug. 21-23, 1997, Budapest, Hungary, pp. 941-954.
Nelson, et al, "Adaptive Inverse Filters for Stereophonic Sound Reproduction," IEEE Transactions on Signal Processing, vol. 40, No. 7, Jul. 1992, pp. 1621-1632.
Nelson, P. A., "Active Control of Acoustic Fields and the Reproduction of Sound," Journal of Sound and Vibration, vol. 177, No. 4, Nov. 3, 1994, pp. 447-477.
Nelson, et al, "Inverse Filter Design and Equalization Zones in Multichannel Sound Reproduction," IEEE Transactions on Speech and Audio Processing, vol. 3, No. 3, May 1995, pp. 185-192.
Nelson, et al, "Multichannel Signal Processing Techniques in the Reproduction of Sound," Journal of the Audio Engineering Society, vol. 44, No. 11, Nov. 1996, pp. 973-989.
Nelson, et al, "Experiments on a System for the Synthesis of Virtual Acoustic Sources," Journal of the Audio Engineering Society, vol. 44, No. 11, Nov. 1996, pp. 990-1007.
Nelson, et al, "Sound Fields for the Production of Virtual Acoustic Images," Journal of Sound and Vibration, vol. 204, No. 2, 1997, pp. 386-396.
Takeuchi, et al, "The Effects of Reflections on the Performance of Virtual Acoustic Imaging Systems," Proceedings of Active 97, The 1997 International Symposium on Active Control of Sound and Vibration, Aug. 21-23, 1997, Budapest, Hungary, pp. 927-940.
"LDSG Introduction—Enclosure designs," sponsored by Sonic Craft, Jul. 17, 2002.
P. Messenger, "KEF's Khameleon," *Hi-Fi News & Record Review*, Sep. 1984, pp. 29, and last page.
M. Colloms, "An Exercise in Conjugation," Hi-Fi News & Record Review, Sep. 1984, pp. 53-57.
*Apple, Inc.* v. *Lawrence R. Fincham*, Case IPR2014-00234, U.S. Pat. No. 8,457,340, Dec. 23, 2013.
*Apple, Inc.* v. *Lawrence R. Fincham*, Case IPR2014-00235, U.S. Pat. No. 7,433,483, Dec. 23, 2013.
Amendment and Response to Office Action Pursuant to 37 C.F.R. 1.111, U.S. Appl. No. 10/937,796, dated Apr. 9, 2008.
Exhibit 1002, *Apple, Inc.* v. *Lawrence R. Fincham*, Case IPR2014-00234, U.S. Pat. No. 8,457,340, Dec. 23, 2013, Declaration of Jeffrey S. Vipperman, Ph.D., regarding claims 1-7 and 29-34 of U.S. Pat. No. 8,457,340.
Exhibit 1002, *Apple, Inc.* v. *Lawrence R. Fincham*, Case IPR2014-00235, U.S. Pat. No. 7,433,483, Dec. 23, 2013, Declaration of Jeffrey S. Vipperman, Ph.D., regarding claims 1-6, 8, 10, 16, and 18-20 of U.S. Pat. No. 7,433,483.
Merriam's New World Dictionary, Second College Edition, p. 734 (1974) ("Merriam's New World Dictionary").
Preliminary Response, filed Mar. 24, 2014, *Apple, Inc.* v. *THX Ltd*, Case IPR2014-00234, U.S. Pat. No. 8,457,340.
Exhibit 2001, *Apple, Inc.* v. *THX Ltd*, Case IPR2014-00234, U.S. Pat. No. 8,457,340, Comparison of Vipperman Decl to 340 Petition.
Exhibit 2002, *Apple, Inc.* v. *THX Ltd*, Case IPR2014-00234, U.S. Pat. No. 8,457,340, FH for Apple Patent Application 13-327649.
Exhibit 2003, *Apple, Inc.* v. *THX Ltd*, Case IPR2014-00234, U.S. Pat. 8,457,340, An Introduction to Horn Theory.
Exhibit 2004, *Apple, Inc.* v. *THX Ltd*, Case IPR2014-00234, U.S. Pat. No. 8,457,340, Merriam-Webster Online Dictionary, Driver—Definition and More, (originally, reprinted Mar. 23, 2014, http://www.merriam-webster.com/dictionary/driver).
Exhibit 2005, *Apple, Inc.* v. *THX Ltd*, Case IPR2014-00234, U.S. Pat. No. 8,457,340, Distributed Mode Loudspeakers.
Exhibit 2006, *Apple, Inc.* v. *THX Ltd*, Case IPR2014-00234, U.S. Pat. No. 8,457,340, NXT, Henry Azime, (originally, reprinted Mar. 24, 2014, http://www.vxm.com/NXT).
Exhibit 3001, *Apple, Inc.* v. *THX Ltd*, Case IPR2014-00234, U.S. Pat. No. 8,457,340, Merriam-Webster Dictionary, Straight-Definition and More, (originally, reprinted Apr. 17, 2014, http://www.merriam-webster.com/dictionary/straight).
Exhibit 3002, *Apple, Inc.* v. *THX Ltd*, Case IPR2014-00234, U.S. Pat. No. 8,457,340, The Random House Dictionary, editor Jess Stein, Ballantine Books, 1978, pp. 874-875.
Exhibit 3003, *Apple, Inc.* v. *THX Ltd*, Case IPR2014-00234, U.S. Pat. No. 8,457,340, Sound. (2013). In The Columbia Encyclopedia. Retrieved from http://search.credoreference.com/content/entry/columency/sound/.
Exhibit 3004, *Apple, Inc.* v. *THX Ltd*, Case IPR2014-00234, U.S. Pat. No. 8,457,340, Sound. (1988). In Illustrated dictionary of science, Andromeda. Retrieved from http://search.credoreference.com/content/entry/andidsci/sound/1.
Patent Owner Mandatory Notices, filed Dec. 27, 2013, *Apple, Inc.* v. *THX Ltd*, Case IPR2014-00234, U.S. Pat. No. 8,457,340.
Decision on Institution of Inter Partes Review, entered Jun. 11, 2014, *Apple, Inc.* v. *THX Ltd*, Case IPR2014-00234, U.S. Pat. No. 8,457,340.
Patent Owner Mandatory Notices, filed Dec. 27, 2013, *Apple, Inc.* v. *THX Ltd*, Case IPR2014-00235, U.S. Pat. No. 7,433,483.
Preliminary Response, filed Mar. 24, 2014, *Apple, Inc.* v. *THX Ltd*, Case IPR2014-00235, U.S. Pat. No. 7,433,483.
Decision on Institution of Inter Partes Review, entered Jun. 11, 2014, *Apple, Inc.* v. *THX Ltd*, Case IPR2014-00235, U.S. Pat. No. 7,433,483.
Patent Owner THX, Ltd.'s Proposed List of Motions, filed Jun. 23, 2014, *Apple, Inc.* v. *THX Ltd*, Case IPR2014-00235, U.S. Pat. No. 7,433,483.
Petitioner's List of Proposed Motions, filed Jun. 23, 2014, *Apple, Inc.* v. *THX Ltd*, Case IPR2014-00235, U.S. Pat. No. 7,433,483.
Order Conduct of the Proceeding, entered Jun. 26, 2014, *Apple, Inc.* v. *THX Ltd*, Case IPR2014-00235, U.S. Pat. No. 7,433,483.
Response of Patent Owner THX Ltd. to Petition, filed Sep. 26, 2014, *Apple, Inc.* v. *THX Ltd*, Case IPR2014-00235, U.S. Pat. No. 7,433,483.
Petitioner's Reply to Patent Owner's Response, filed Nov. 10, 2014, *Apple, Inc.* v. *THX Ltd*, Case IPR2014-00235, U.S. Pat. No. 7,433,483.
Petitioner's Request for Oral Argument, filed Dec. 23, 2014, *Apple, Inc.* v. *THX Ltd*, Case IPR2014-00235, U.S. Pat. No. 7,433,483.
Patent Owner's Request for Oral Argument, filed Dec. 23, 2014, *Apple, Inc.* v. *THX Ltd*, Case IPR2014-00235, U.S. Pat. No. 7,433,483.
Order Conduct of the Proceeding, entered Jan. 13, 2015, *Apple, Inc.* v. *THX Ltd*, Case IPR2014-00235, U.S. Pat. No. 7,433,483.
Patent Owner's Corrected Motion for Observation Regarding Cross Examination of Petitioner's Reply Witness Dr. Jeffrey S. Vipperman, filed Jan. 16, 2015, *Apple, Inc.* v. *THX Ltd*, Case IPR2014-00235, U.S. Pat. No. 7,433,483.
Petitioner's Response to Patent Owner's Corrected Observations on Cross-Examination of Dr. Vipperman, filed Jan. 21, 2015, *Apple, Inc.* v. *THX Ltd*, Case IPR2014-00235, U.S. Pat. No. 7,433,483.
Petitioner's Demonstratives for Oral Argument, filed Feb. 12, 2015, *Apple, Inc.* v. *THX Ltd*, Case IPR2014-00235, U.S. Pat. No. 7,433,483.
Deposition transcript of Stephen John Elliott, Ph.D. from Oct. 30, 2014, *Apple, Inc.* v. *THX Ltd*, Case IPR2014-00235, U.S. Pat. No. 7,433,483.
Exhibit 1017, *Apple, Inc.* v. *THX Ltd*, Case IPR2014-00235, U.S. Pat. No. 7,433,483, Second Declaration of Jeffery S. Vipperman, Ph.D., Regarding Claims 1-3 of U.S. Pat. No. 7,433,483, filed Nov. 10, 2014.

(56) References Cited

OTHER PUBLICATIONS

Exhibit 1018, *Apple, Inc*. v. *THX Ltd*, Case IPR2014-00235, U.S. Pat. No. 7,433,483, Errata Sheet of Dr. Vipperman Deposition of Dec. 16, 2014.
Exhibit 2001, *Apple, Inc*. v. *THX Ltd*, Case IPR2014-00235, U.S. Pat. No. 7,433,483, Comparison of Vipperman Declaration to 483 Petition.
Exhibit 2007, *Apple, Inc*. v. *THX Ltd*, Case IPR2014-00235, U.S. Pat. No. 7,433,483, Declaration of Dr. Stephen Elliott, filed Sep. 26, 2014.
Exhibit 2008, *Apple, Inc*. v. *THX Ltd*, Case IPR2014-00235, U.S. Pat. No. 7,433,483, Curriculum Vitae of Dr. Stephen Elliott, filed Sep. 26, 2014.
Exhibit 2009, *Apple, Inc*. v. *THX Ltd*, Case IPR2014-00235, U.S. Pat. No. 7,433,483, Acoustics, Leo L. Beranek, McGraw-Hill Electrical and Electronic Engineering Series, 1954, pp. 206-259; 266-275; 298-301; and 350-353.
Exhibit 2010, *Apple, Inc*. v. *THX Ltd*, Case IPR2014-00235, U.S. Pat. No. 7,433,483, Acoustical Engineering, Harry F.Olson, D. Van Nostrand Company, Inc., 1957, pp. 122-169.
Exhibit 2011, *Apple, Inc*. v. *THX Ltd*, Case IPR2014-00235, U.S. Pat. No. 7,433,483, Loudspeakers for Music Recording and Reproduction, Philip Newell and Keith Holland, Focal Press, 2007, pp. 64-105.
Exhibit 2012, *Apple, Inc*. v. *THX Ltd*, Case IPR2014-00235, U.S. Pat. No. 7,433,483, A Bandpass Loudspeaker Enclosure, L. R. Fincham, presented at the 63rd Convention May 15 through 18, 1979 Los Angeles, AES an Audio Engineering Society Preprint.
Exhibit 2013, *Apple, Inc*. v. *THX Ltd*, Case IPR2014-00235, U.S. Pat. No. 7,433,483, High Performance Loudspeakers, Martin Colloms and Paul Darlington, John Wiley & Sons Ltd., 2005, pp. 184-188.
Exhibit 2014, *Apple, Inc*. v. *THX Ltd*, Case IPR2014-00235, U.S. Pat. No. 7,433,483, Fundamental of Acoustics, Fourth Edition, Lawrence E. Kinsler, et al, John Wiley & Sons, Inc. 2000, pp. 340-342.
Exhibit 2015, *Apple, Inc*. v. *THX Ltd*, Case IPR2014-00235, U.S. Pat. No. 7,433,483, Theoretical Acoustics, Philip M. Morse, et. al, McGraw-Hill Book Company, undated, pp. 492-507.
Exhibit 2016, *Apple, Inc*. v. *THX Ltd*, Case IPR2014-00235, U.S. Pat. No. 7,433,483, Submission of Errata Sheet for Deposition Transcript of Dr. Stephen J. Elliott.
Exhibit 2017, *Apple, Inc*. v. *THX Ltd*, Case IPR2014-00235, U.S. Pat. No. 7,433,483, Deposition transcript of Jeffrey Stuart Vipperman, Ph.D. from Dec. 16, 2014.
Exhibit 2018, *Apple, Inc*. v. *THX Ltd*, Case IPR2014-00235, U.S. Pat. No. 7,433,483, Submission of Patent Owner's Demonstrative Exhibits for Oral Argument on Feb. 18, 2015.
Apple Inc.'s Invalidity Contentions, Civil Action No. 3:13-cv-01161-(HSG), USDC, Northern District of California, Sep. 24, 2015.

* cited by examiner

NARROW PROFILE SPEAKER CONFIGURATIONS AND SYSTEMS

RELATED APPLICATION INFORMATION

This application is a continuation of U.S. application Ser. No. 13/208,923 filed Aug. 12, 2011, which is a continuation of Ser. No. 12/246,433 filed Oct. 6, 2008 now U.S. Pat. No. 8,027,500, which is a divisional application of U.S. application Ser. No. 10/937,796 filed Sep. 8, 2004, now U.S. Pat. No. 7,433,488, which is a continuation-in-part application of U.S. application Ser. No. 10/339,357 filed Jan. 8, 2003, now U.S. Pat. No. 7,457,425, which is a continuation-in-part application of utility application U.S. application Ser. No. 10/074,604 filed on Feb. 11, 2002, now U.S. Pat. No. 7,254,239, (which claims the benefit of U.S. Provisional Application Ser. No. 60/267,952, filed on Feb. 9, 2001), said U.S. application Ser. No. 10/339,357 further claims the benefit of U.S. Provisional Application Ser. No. 60/331,365, filed Jan. 8, 2002, and of PCT Application Ser. No. PCT/US02/03880, filed on Feb. 8, 2002, all of which are hereby incorporated by reference as if set forth fully herein.

BACKGROUND OF THE INVENTION

1. Field of the Invention

The field of the present invention relates to sound reproduction and, more specifically, to speaker configurations and enclosures, and related sound processing.

2. Background

Sound reproduction systems incorporating speakers are commonplace in homes, theaters, automobiles, places of entertainment, and elsewhere. The number, size, quality, characteristics, and arrangement of speakers affect sound quality in virtually any listening environment. However, many environments have constraints which limit the number, size, or type of speakers which can be used, and their arrangement. These constraints may be technical, mechanical, or aesthetic in nature.

For example, with respect to consumer products such as computers and televisions, there may be limited space to physically attach or integrate speakers. A common practice is to provide a set of external speakers separate from the enclosure of the computer, television, or other product, allowing the user the ability to place the speakers widely apart and thus achieve a true stereo effect. However, loose speakers take up space on a desk or table, and require unsightly or inconvenient electrical connections to the computer, television, or other product. Moreover, use of such additional external speakers generally requires the consumer to purchase them separately from the main product itself, thus increasing cost. In addition, space restrictions on a desk or table may limit the possible locations of speakers, and/or their number, size and orientation, and thus adversely affect sound quality including the desired stereo effect.

For consumer items such as laptop computers, the option of utilizing external speakers to improve sound quality may not be possible.

Confined listening areas also create constraints which can impact sound quality, and can often unsuitable for optimal sound reproduction. For example, the listening space of an automobile creates particular challenges and problems for quality sound reproduction. These problems partially result from the unique sound environment of the automobile when compared with a good listening room. Among the disadvantages are:

- Much smaller internal volume resulting in a reduced reverberation time and lower modal density at low frequencies resulting in a lack of ambience and an uneven bass response.
- The proximity of highly reflective surfaces (such as the windows) to highly absorptive areas such as the upholstery or the occupants clothing leads to a great variability with frequency and head position of the direct to indirect sound arriving at the listener. Consequently even small changes in head or seating position can cause significant and undesirable changes in the timbral quality of the music.
- The listening positions are necessarily restricted to the seating positions provided (usually 4 or 5) and all of these are very asymmetrically placed with respect to the speaker positions. Space is always at a premium within a car interior and as a result the speakers are often placed in physically convenient positions, that are nevertheless very poor from an acoustic point of view, such as the foot wells and the bottom of the front and rear side doors. As a result the listener's head is always much closer to either the left or right speaker leading directly large inter-channel time differences and different sound levels due to the 1/r law.
- Additionally, the angles between the axes from the listeners ears to the axes of symmetry of the left and right speakers is quite different for each occupant. The perceived spectral balance is different for each channel due to the directional characteristics of the drive units. Masking of one or more speakers by the occupants clothes or legs can often result in the attenuation of the mid- and high-frequencies by as much as 10 dB.

The conditions noted above tend to adversely impact the ability to produce high quality stereo reproduction, which ideally has the following attributes:

- A believable and stable image or soundstage resulting from the listener being nearly equidistant from the speakers reproducing the left and right channels and a sufficiently high ratio of direct-to-indirect sound at the listener's ears.
- A smooth timbral balance at all the listening positions.
- A sense of ambience resulting from a uniform soundfield.

Some features are provided in automobile audio systems which can partially mitigate the aforementioned problems. For example, an occupant can manually adjust the sound balance to increase the proportional volume to the left or right speakers. Some automobile audio systems have a "driver mode" button which makes the sound optimal for the driver. However, because different listening axes exist for left and right occupants, an adjustment to the balance that satisfies the occupant (e.g., driver) on one side of the automobile will usually make the sound worse for the occupant seated on the other side of the automobile. Moreover, balance adjustment requires manual adjustment by one of the occupants, and it is generally desirable in an automobile to minimize user intervention.

Another modification made to some automobile audio systems is to provide a center speaker, which reduces the image instability that occurs when the listener is closer to either the left or right speaker when both are reproducing the same mono signal, with the intention of producing a central sound image. Yet another possible approach is adding more speakers in a greater variety of positions (e.g., at the seat tops). While such techniques can sometimes provide a more pleasing effect, they cannot provide stable imaging as the problems associated with asymmetry described above still remain. The considerable additional cost of such design approaches is usually undesirable in markets such as the highly cost sensitive and competitive automotive industry. Moreover, as previously noted, space is usually at a premium in the automobile interior, and optimal speaker positions are limited.

The aforementioned problems are not limited to sound systems designed for automobiles, but may exist in other confined spaces as well. Even in larger spaces, it may be difficult to achieve ideal sound reproduction due to constraints on where speakers may be located, or other considerations. Freestanding speakers can take up valuable room space, while speakers embedded in walls and ceilings require a large cross-sectional areas and may be aesthetically displeasing. More generally, in many environments it is desirable to minimize the visual impact of speakers in a sound reproduction system. One technique, for example, is to color or otherwise decorate the protective speaker faceplate to match the surrounding wall or object in which the speaker in placed, or to hide speakers behind an artificial painting. These types of solutions may not be satisfactory for all consumers, and may limit the possibilities for optimal speaker placement as well.

It would therefore be advantageous to provide an improved sound reproduction and/or speaker system which overcomes the foregoing problems, and/or provides other benefits and advantages.

SUMMARY OF THE INVENTION

Certain embodiments disclosed herein are generally directed, in one aspect, to a sound reproduction system having a speaker configuration and/or enclosure which provides a relatively narrow sound output region in relation to the size of the speaker face(s) utilized in the sound reproduction system. In some embodiments, a reflecting surface disposed immediately in front of the face of the speaker cone redirects the sound output, through a sound duct or otherwise, and causes the sound to emanate from a slot or other aperture. Single or multiple speaker embodiments are possible, with a single or multiple slots or other apertures. Sound-damping material may be added to define a sound duct, preferably around the periphery of the speaker cone(s), so as to influence the directivity of the sound waves towards the output slot or aperture, and/or to reduce potentially interference.

Further embodiments, variations and enhancements are also disclosed herein.

BRIEF DESCRIPTION OF THE DRAWINGS

FIG. 19A is a diagram of a speaker mounting structure or enclosure illustrating a particular arrangement of sound-damping material around the speakers, while

DETAILED DESCRIPTION OF PREFERRED EMBODIMENTS

Certain embodiments disclosed herein are generally directed, in one or more aspects, to a speaker configuration or enclosure for a sound reproduction system which provides a relatively narrow sound output region in relation to the size of the speaker face(s) utilized in the sound reproduction system. In some embodiments, a reflecting surface disposed immediately in front of the face of the speaker cone redirects the sound output, through a sound duct or otherwise, and causes the sound to emanate from a slot or other aperture. In some instances, such a configuration allows the speaker(s) to be hidden from view, provides a relatively broad directional characteristic, allows a larger speaker to be used in a confined installation space than would otherwise be convenient or possible, and/or provides other benefits or advantages. Single or multiple speaker embodiments are possible, allowing a wide variety of potential speaker arrangements.

Embodiments as disclosed herein may be employed in a variety of applications, and may be particularly well suited for situations in which it is desired to conceal speakers from view, or in which audio systems face restrictions with respect to, for example, speaker locations or installation area. In certain multiple speaker embodiments, a plurality of speakers may be mounted along a sound duct, at either the same or variable distances from an output slot or aperture, such that the output from the speakers exits a common output slot or aperture. In some embodiments, as further described herein, the audio signal(s) to the speakers may be processed and/or delayed to ensure that the sound waves generated by each speaker's audio output reinforce rather than interfere with one another. Speakers receiving similar audio signals may be mounted to face each other across a duct, either directly or separated by, for example, a frammel (such as a sound-blocking baffle between two proximal speakers). Arrays of opposing speakers may be configured using the same principles. The use of a narrow profile speaker enclosure may be in connection with other speakers, such as tweeters, to further enhance the sound quality experienced by the listener. The speaker configuration may be advantageously employed in applications such as electronic devices, desktop computer monitors, and so on, or any application in which a low speaker profile may be advantageous or desirable.

Figure 1:
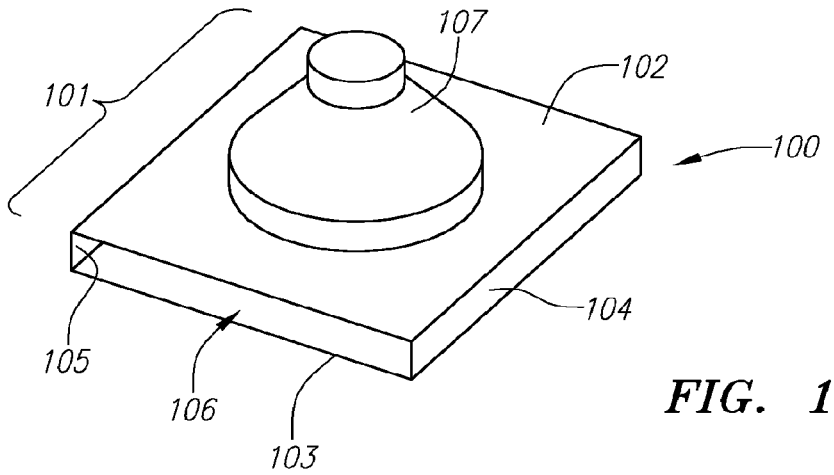
FIG. 1 is an oblique frontal view diagram of a narrow profile speaker unit having a slot for sound output, in accordance with one embodiment as disclosed herein.

FIG. 1 is a diagram of a narrow profile speaker unit 100 having a slot for sound output, and illustrated from an oblique frontal view, in accordance with one or more embodiments as disclosed herein. In FIG. 1, a speaker 107 is supported by a baffle 101 comprising a mounting surface (or other barrier) 102, a sound reflecting surface 103 disposed preferably in parallel orientation to the mounting surface 102, and side walls 104 and 105, which collectively define a sound duct 115 having an output slot (or other orifice) 106 for radiating sound produced by the speaker 107. The baffle 101 in FIG. 1 is adapted to receive the cone of the speaker 107 such that the primary acoustic output of the speaker 107 is directed towards the sound reflecting surface 103, and ultimately emanated from the output slot 106. The presence of mounting surface (or other barrier) 102 may provide the desirable effect of, among other things, acoustically isolating the speaker's rear radiation from its front radiation.

The speaker 107 may receive an audio input signal from any audio signal source such as, for example, a CD player, cassette player, radio, etc., with or without intervening sound processing. The audio input signal may also optionally be applied, either directly or via a sound processor, to additional drivers or other speakers (not shown).

Figure 2A:
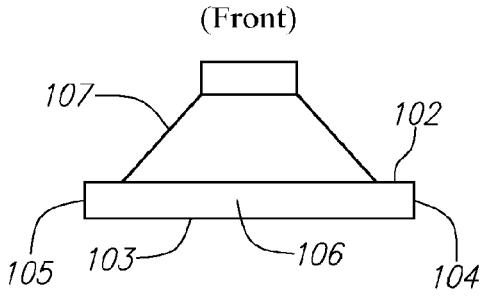
FIGS. 2A and 2B are front and side view diagrams, respectively, of the narrow profile speaker unit of FIG. 1.
Figure 2B:
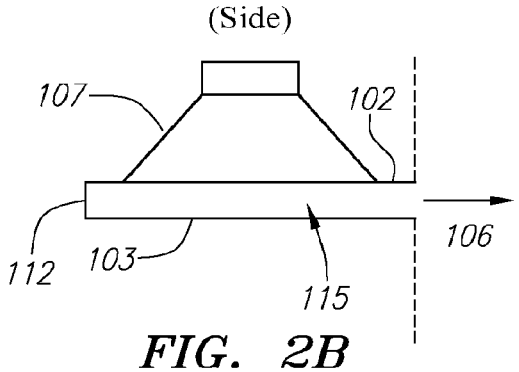

FIGS. 2A and 2B are front and side view diagrams, respectively, of the speaker unit 100 of FIG. 1. FIG. 2B, in particular, illustrates the direction of sound output (shown as an arrow) from the output slot 106, generally perpendicular to the sound reflecting surface 103 and the front face of the speaker 107. Preferably, the sound reflecting surface 103 is spaced at a distance from the front face of the speaker 107 such that the duct or chamber 115 defined by the surrounding sidewalls 104, 105 and backwall 112 does not permit soundwaves of the primary acoustic output from the speaker 107 to unfold significantly within the confines of the duct 115, as pressure effects will tend to cause the lateral soundwaves that emanate from the output slot 106 to have sound quality and dynamic range comparable to the soundwaves initially emitted from the speaker 107 itself.

The output slot (or other orifice) 106 may be of any suitable shape, but is preferably configured so as to provide a relatively narrow profile from which sound of the speaker unit 100 radiates. The output slot 106 may, for example, be generally rectangular in shape (as illustrated in the front view of FIG. 2A), or may be generally oval or elliptical, or may have slightly curved top and/or bottom edges (i.e., the edges of mounting surface 102 and/or sound reflecting surface 103). The output slot 106 is preferably symmetrical and shaped so as to minimize any interference with the desired sound reproduction.

With the speaker unit 100 of FIG. 1, the output slot 106 may be generally configured so as to provide a narrower profile of the effective area from which the soundwaves emanate, as compared to the front face of the speaker 107. As a result, the speaker unit 100 may, for example, utilize a smaller surface area for sound projection, as compared to a conventional forward-oriented speaker. Such a narrower forward profile can provide a number of advantages. From the perspective of speaker arrangement and installation, for example, the speaker unit 100 in various embodiments may find advantageous used in applications having limited space, or where there is a desire to conceal the presence of the speaker(s) from view. For example, a speaker unit with narrow profile sound output slot may find practical use in, e.g. an automobile sound system, and could be placed in a vehicle dashboard or other suitable location. Other advantageous uses are described herein, or would become apparent to those skilled in the art after reviewing the instant specification and drawings.

Besides flexible placement options, another potential benefit of a speaker unit arrangement in accordance with FIG. 1 is that sound emanating from the output slot 106 may generally tend to have a wide dispersion angle along the slot's long axis, as compared to the dispersion angle of a conventional speaker (e.g., a round, forward-oriented speaker face). Thus, the slotted speaker unit 100 may possess an extremely broad directional characteristic over the frequency range for which the wavelength of sound in air is large compared with the slot dimensions. For example, a slot having a dimension of 10×60 millimeters may provide a substantially omnidirectional radiation pattern up to 2 to 3 kHz.

Because of the wide dispersion angle along the long axis, a speaker unit 100 in accordance with FIG. 1 may provide a similar listening experience with respect to off-axis listeners at a variety of locations away from the center axis of the output slot 106. The advantageous dispersion characteristics may permit design choices that, for example, account for the relative likelihood that listeners will be positioned along one or the other axis of the soundwaves emanating from the output slot 106. These design choices, generally not available for equiaxed drivers, are particularly advantageous in confined listening spaces. In an automobile, for example, wherein listeners are generally confined to their seats, an embodiment of the speaker unit 100 having a horizontally oriented output slot 106 at approximately dashboard level could be installed such that the sound emanating from the slot 106 is characterized by a wide horizontal (left to right) dispersion angle across both the driver and passenger seats, and a narrow vertical dispersion angle that is sufficient to include the upper regions of the driver and passenger seats at a height which the heads of the seated driver and passenger are typically located.

The speaker unit 100 illustrated in FIG. 1 may also be well suited for use in other types of confined areas, particularly where the location of the listeners is predictable in advance. One example of is illustrated in FIG. 7, which illustrates sound radiating from a slotted speaker unit (such as shown in FIGS. 1 and 2A-2B) into a room 700 of listeners 721, 722. In this example, the speaker unit 704, shown in side view, is positioned within the ceiling 730 of the room 700, with the speaker 707 oriented generally perpendicular to the direction of sound radiation. A sound reflecting surface 708 (analogous to 103 in FIGS. 1 and 2A-2B) defines, along with the face of speaker 707 and various sidewalls and backwall, a relatively narrow duct 713, and directs the soundwaves towards an output slot in the ceiling 730. The sound volume quality remains relatively constant regardless of whether listeners are on or off-axis. Moreover, because the sound is radiated from a relatively narrow slot, the presence of the speaker 707 can be substantially concealed. A similar configuration may be used with other speaker units disclosed herein, such as, for example, speaker units illustrated in or described with respect to FIG. 3A, 3B, 3C, 6, or others.

In one aspect, the sound duct 115 of speaker unit 100 effectively "turns" the soundwaves output from the speaker 107 by 90° (in this example), so that the sound is carried to the output slot 106 and released while retaining a sufficient degree of sound quality, and modifying the effective shape of the speaker output from an elliptical or circular radiator (as the case may be for speaker 107) to a rectangular radiator. In addition, the total radiating surface area can be advantageously reduced, as compared to the radiating surface area of the speakers themselves, minimizing the space needed in, e.g., a vehicle dash or other environments. The aspect ratio of the output slot 106 can be adjusted or tailored to modify the directional characteristic of the acoustic output in order to, for example, improve sound quality at off-axis listening positions. While the size and shape of the sound duct 115 and output slot 106 may vary depending upon the particular design goals, there may be physical or practical limitations to how narrow the sound duct 115 and/or output slot 106 may be made. Narrowing of the sound duct 115 and/or output slot 106 may, for example, potentially decrease the efficiency of the speakers (which may be compensated by larger speakers and/or increased drive power), or may cause audible noise from turbulence. Therefore, the narrowness of the sound duct 115 and/or output slot 106 may be limited by, among other things, impedance losses that cannot be made up by increased drive power and the onset of sound artifacts or noise caused by turbulence or nonlinear airflow.

Figure 3A:
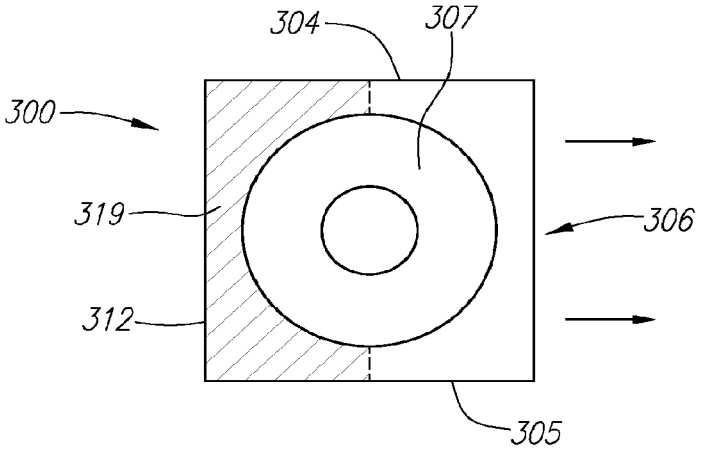
FIGS. 3A, 3B, and 3C are diagrams of cross-sectional top views of alternative embodiments of the enclosure of the speaker unit of FIG. 1 with different arrangements of sound damping material in the enclosure.
Figure 3B:
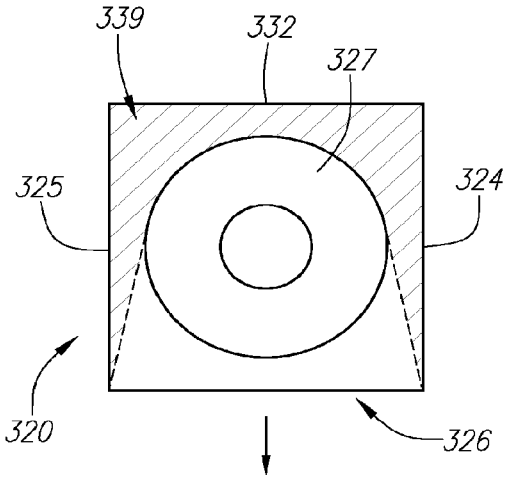
Figure 3C:
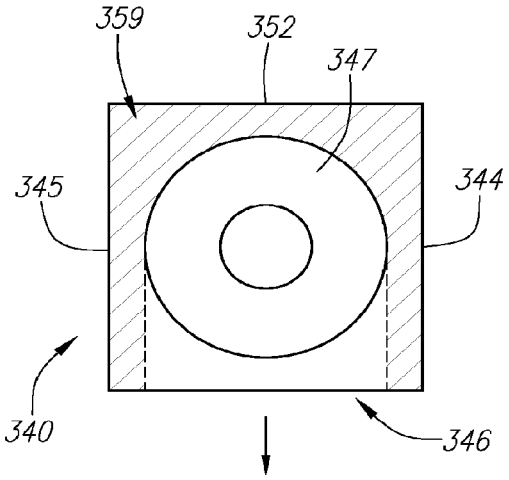

Variations of the speaker unit embodiment illustrated in FIG. 1 are shown in FIGS. 3A, 3B, and 3C, which show cross-sectional top views of a speaker unit with different arrangements of sound damping material in the enclosed chamber or duct 115. In FIG. 3A, sidewalls 304, 305 and backwall 312 of speaker unit 300 are analogous to sidewalls 104, 105 and backwall 112, respectively, shown in FIG. 1. FIG. 3A illustrates the placement of sound damping material 319 within the duct or chamber (shown as 115 in FIG. 2B), such that the sound damping material 319 reaches approximately the half-way point along sidewalls 304, 305, but is contoured in the middle to circumscribe the periphery of half of the cone of speaker 307. Sound output from speaker 307 emanates from output slot 306, as with FIG. 1. The sound damping material 319 may help prevent, e.g., undesirable interference or reflections within the duct or chamber, that may otherwise be caused by soundwaves reflecting from the backwall 312 or back corners of the chamber, since the soundwaves have no means of egress except the slot 306. The sound damping material 319 may in certain embodiments also help to prevent the creation of standing waves, and/or minimize the variation of sound output response with respect to frequency so that the speaker output can be readily equalized by, e.g., any standard techniques, including analog or digital equalization. For example, cascaded filter sections may be employed to tailor the frequency response of the speakers 307 in discrete frequency bands so as to provide a relatively uniform overall frequency response.

The sound damping material 319, in FIG. 3A and other embodiments as will hereinafter be described, may comprise any suitable material, and is preferably non-resonant in nature, with sound absorbing qualities. The sound damping material 319 may, for example, comprise expanded or compressed foam, or else may comprise rubber, reinforced paper, fabric or fiber, damped polymer composites, or other materials or composites, including combinations of the foregoing materials.

FIG. 3B illustrates a variation of the speaker unit 300 of FIG. 3A, but with a different shape of sound damping material 339. In FIG. 3B, sidewalls 324, 325 and backwall 332 of speaker unit 320 are analogous to sidewalls 104, 105 and backwall 112, respectively, shown in FIG. 1. FIG. 3B illustrates the placement of sound damping material 339 within the duct or chamber (shown as 115 in FIG. 2B), such that the sound damping material 339 tapers to the approximate end of sidewalls 324, 325, and, similar to FIG. 3A, is contoured to circumscribe the periphery of the cone of speaker 327. Sound output from speaker 327 emanates from output slot 326, as with FIG. 1. The sound damping material 339 serves a similar purpose to sound damping material 319 illustrated in FIG. 3A, and may further reduce the possibility of reflections from sidewalls 324, 325 and/or standing (lateral) waves.

FIG. 3C illustrates another variation of the speaker units 300 and 320 of FIGS. 3A and 3B, with yet a different shape of sound damping material 359. In FIG. 3C, sidewalls 344, 345 and backwall 352 of speaker unit 340 are analogous to sidewalls 104, 105 and backwall 112, respectively, shown in FIG. 1. FIG. 3C illustrates the placement of sound damping material 359 within the duct or chamber (shown as 115 in FIG. 2B), such that the sound damping material 359 follows along sidewalls 324, 325 to the edge of the output slot 346 and, similar to FIGS. 3A and 3B, is contoured to circumscribe the periphery of the cone of speaker 327. Sound output from speaker 347 emanates from output slot 346, as with FIG. 1. The sound damping material 359 serves a similar purpose to sound damping material 319 and/or 339 described earlier, but may provide somewhat different sound dispersion characteristics.

Various embodiments of slotted speaker units as described herein may provide a number of advantages, depending potentially upon the specific configuration, environment, and other factors. For example, a slotted speaker unit may have the effect of transforming an elliptical sound radiator (i.e., conventional conical speaker) and effectively transform it into, e.g., a rectangular or almost linear sound radiator, with excellent coverage at the radiated angles. In addition to sound quality, a slotted speaker unit may provide opportunity to improve the packaging and appearance of the speaker unit. As will be described in more detail hereinafter, use of an output slot to radiate sound provides the opportunity for placing speaker outputs very near each other, reducing out-of-phase, cross-cancellation, and lobing effects that may otherwise occur from the use of multiple speakers.

Figure 4A:
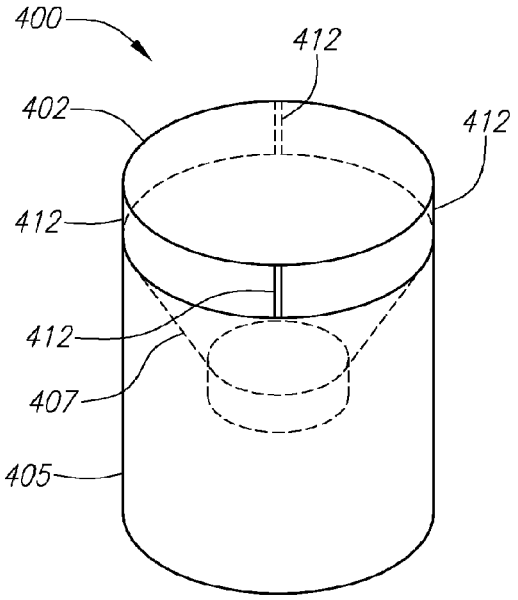
FIGS. 4A and 4B are diagrams of oblique and side views, respectively, of a cylindrical speaker unit having a sound output slot, in accordance with one embodiment as disclosed herein.
Figure 4B:
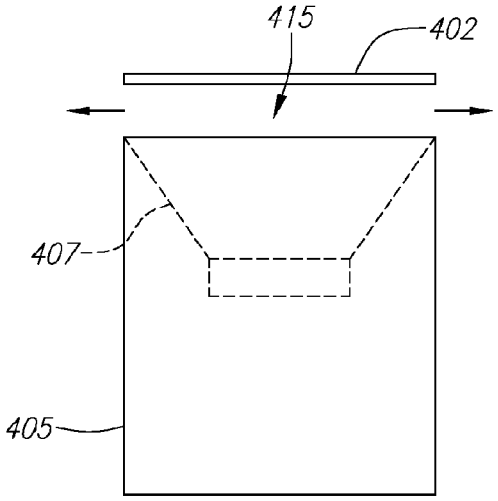

An example another embodiment of a speaker unit in accordance with certain principles of FIG. 1 is illustrated in FIGS. 4A and 4B, which depict oblique and side views, respectively, of a cylindrical speaker unit 400. The speaker unit 400 comprises a cylindrical housing 405, roughly can-shaped, in which is placed a speaker 407 positioned such that its cone faces outward from one end of the cylindrical housing 405. In the example shown, the edge of the cone of the speaker 407 matches the contours of the edge of the cylindrical housing 405, but in other variations the diameter of the cone may be smaller than the diameter of the cylindrical housing 405, or else the speaker 407 may be positioned with an offset from (above or below) the top edge of the cylindrical housing 405. A sound reflecting surface 402, analogous to sound reflecting surface 103 in FIG. 1, is positioned as illustrated a distance away from the upper edge of the cylindrical housing 405, such that the upper edge of the cylindrical housing 405 and the sound reflecting surface 402 form a chamber or duct 415 (FIG. 4B) from which sound may emanate, generally perpendicular to the sound reflecting surface 402 as shown by the arrows in FIG. 4B. In the example shown, the sound reflecting surface 402 comprises a circular wall matching the general dimensions of the corresponding end of the cylindrical housing 405. One or more struts 412, for example, may attach the sound reflecting surface 402 to the cylindrical housing 405.

The speaker unit 400 shown in FIGS. 4A and 4B may be of relatively small size and, for example, may be conveniently adapted as desk speakers for a computer or other electronic appliance. The speaker unit 400 may be oriented upwards or downwards, and may provide generally omnidirectional sound output, so that a similar quality of listening experience is provided regardless of which direction the listener is located from the speaker(s). The cylindrical housing 405 and sound reflecting surface 402 may be comprised of a durable material such as, for example, high impact plastic or aluminum, or any other suitable material. While the speaker unit 400 may be advantageously used with, e.g., a computer system, it is not limited to such applications, and may be used in other environments, and may be of any size.

While the speaker housing 405 is illustrated in FIGS. 4A and 4B as a round cylinder, it is not limited to such a shape, and may, for example, be an elliptical cylinder (in which case the speaker 407 may be an elliptical speaker). In other variations, the sound reflecting surface 402 may be replaced by, e.g., a floor or desktop surface, whereby the cylindrical housing 405 is faced downwards with the strut(s) 412 forming a duct or gap between the edge of the speaker 407 and the floor or desktop surface. In yet other embodiments, the strut(s) 412, which are shown along the periphery of the top edge of the cylindrical housing 405, may be replaced by one or more center struts, with a crossbeam (not shown) spanning the diameter of the cylindrical housing 405 and providing a secure footing for the strut(s). In such an embodiment, the strut(s) may generally be attached at or near a centerpoint of the sound reflecting surface 402. Alternatively, with other variations in crossbeam configurations (which may include off-center crossbeams), the strut(s) may be located in virtually any position desired, although any such crossbeams and/or strut(s) are, in various embodiments, formed with as minimal a profile as possible so as to minimize any interface with the sound output. In other embodiments, the strut(s) may be larger, and may even occupy a significant portion of the circumference of the circular boundary of the sound reflecting surface 402 and cylindrical housing 405, particularly in those directions in which it is not necessary to have direct sound radiation from the speaker 407.

Figure 5:
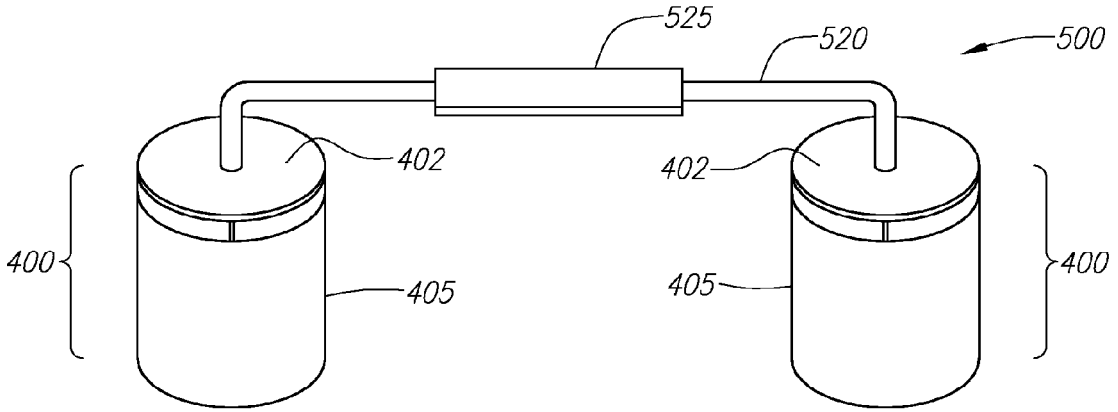
FIG. 5 is a diagram of an example of a speaker system utilizing cylindrical speaker units illustrated in FIG. 4.

Other embodiments may include multiple speaker units of the type illustrated in and described with respect to FIG. 4. For example, a speaker system 500 utilizing cylindrical speaker units 400 of the type shown in FIG. 4, is illustrated in FIG. 5. As shown therein, the speaker system 500 includes a pair of speaker units 400, connected by a connecting beam 520 which is attached (or attachable) to the top portion of the disk-shaped sound reflecting surface 402 of each of the speaker units 400. The speaker system 500 may be conveniently hung, for example, from the top of an electronic appliance (not shown) such as a computer monitor, with the connecting beam 520 resting on the top portion of the electronic appliance. A contacting member 525 may be attached to the connecting beam 520 or integral therewith, for providing a resting surface for contacting the top portion of the electronic appliance. The contacting member 525 may be generally flat as illustrated in FIG. 5, or else may, for example, be contoured so as to match the top portion of the electronic appliance. The contacting member 525 may also be used to securably affix the speaker system 500 to the electronic appliance, where the electronic appliance is configured with mechanism for receiving and securing the contacting member 525. For example, the electronic appliance may be configured with tabs on its top portion for receiving and locking the contacting member 525. Where a contacting member 525 is not provided as part of the speaker system 500, and where the connecting beam 520 is generally rod-shaped, the electronic appliance may be configured with a semi-cylindrical molding on its top portion for receiving and holding the connecting beam 520.

Figure 13A:
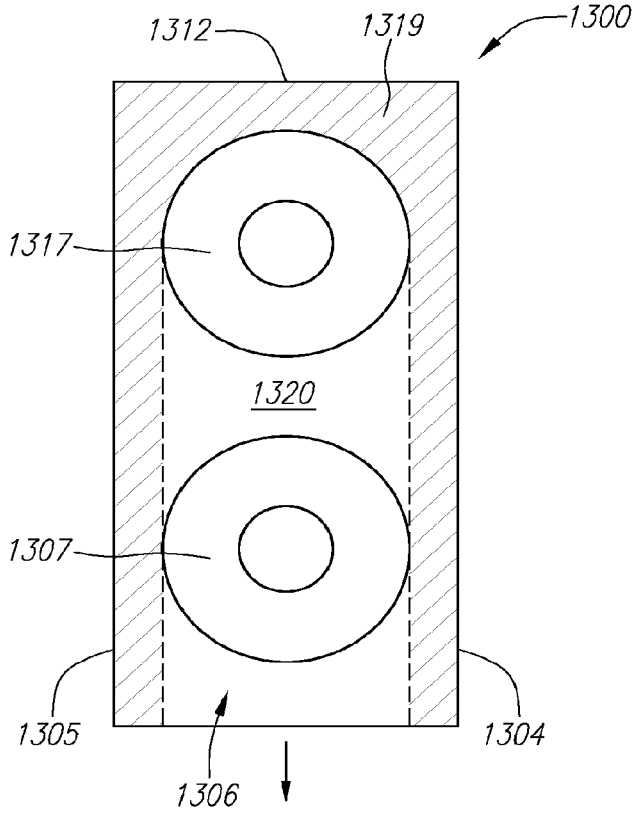
FIG. 13A is a diagram of a speaker unit having multiple speakers and a sound output slot in accordance with another embodiment.

Another embodiment of a narrow profile speaker unit is illustrated in FIG. 13A, which illustrates a top cutaway view of a speaker unit 1300 having two speakers 1307, 1317. In the example shown in FIG. 13A, the two speakers 1307, 1317 are disposed in series along a sound duct 1320 atop a speaker mounting structure such as described previously with respect to, e.g., FIGS. 1 and 2A-2B. The two speakers 1307, 1317 share a common sound output slot 1306, similar to the output slot 106 shown in FIG. 1, but the use of multiple speakers may provide advantages such as, for example, increased output capacity, different frequency ranges for different speakers, or other advantages. Similar to the embodiment illustrated in FIG. 3C, sound-damping material 1319 such as compressed foam surrounds the rear contours of the speaker 1317 furthest from the output slot 1306, and extends to the front of the speaker mounting structure so as to define the sound duct 1320. The sound duct 1320 is preferably (but not necessarily) of substantially uniform width, generally matching the width of speakers 1307 and 1317. The speakers 1307 and 1317 may be of identical size and audio characteristics, or else, in alternative embodiments, may be of different sizes, shapes, and/or audio characteristics.

Figure 13B:
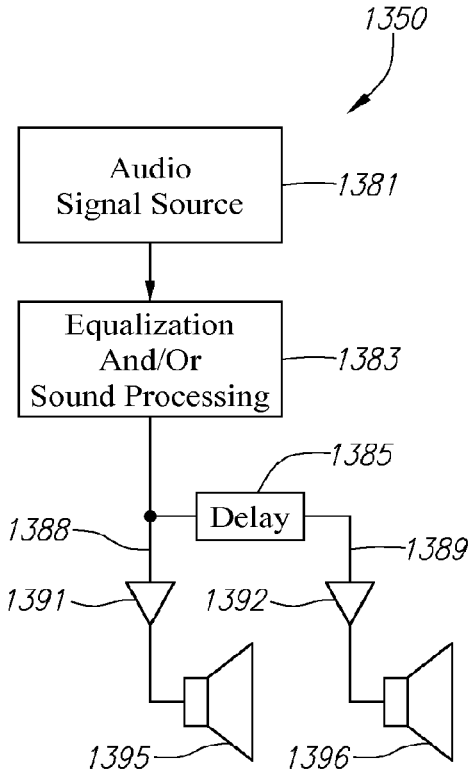
FIG. 13B is a diagram of a sound processing system that may be used in connection with the speaker unit of FIG. 13A.

FIG. 13B is a simplified block diagram of an electronic circuit 1300 that may be used in, e.g., the speaker arrangement of FIG. 13A, wherein a delay mechanism is used to synchronize sound output between the front and rear speakers relative to the output slot. As shown in FIG. 13B, an audio source signal 1381 is optionally fed into an equalization and/or sound processing unit 1383, which generates an audio output signal 1388. The audio output signal 1388 is applied to the "rear" speaker 1395 (e.g., speaker 1317 in FIG. 13A) via driver 1391 and, though a delay circuit 1385, to the "front" left speaker 1396 (e.g., speaker 1307 in FIG. 13A) via driver 1392. A tweeter or other additional speaker may also be provided. The amount of time delay provided by delay circuit 1385 may be derived, e.g., from the distance between the front speaker 1396 and the rear speaker 1395, given the known velocity of sound travel. The amount of time delay may thus be based upon the center-to-center distance between the rear speaker 1395 and the front speaker 1396, divided by the velocity of sound. (about 1116 feet per second). The delay circuit 1385 may take the form of any suitable electronic circuitry (either active or passive, and either analog or digital), and preferably have no impact on the content of the audio output signal 1388, at least over the frequencies being audially reproduced by the speakers 1395, 1396.

Figure 6:
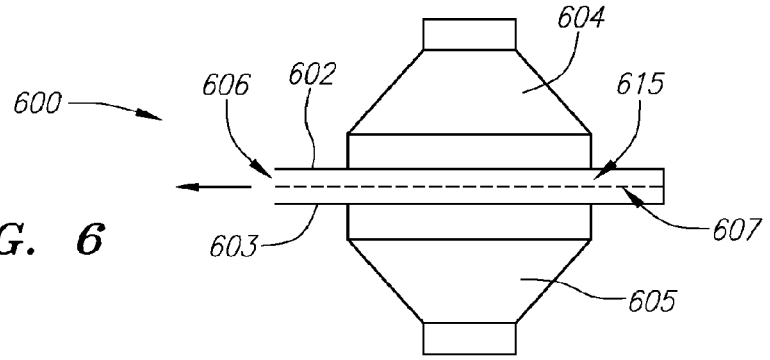
FIG. 6 is a side view of another embodiment of a narrow profile speaker unit in accordance with one embodiment as disclosed herein.
Figure 7:
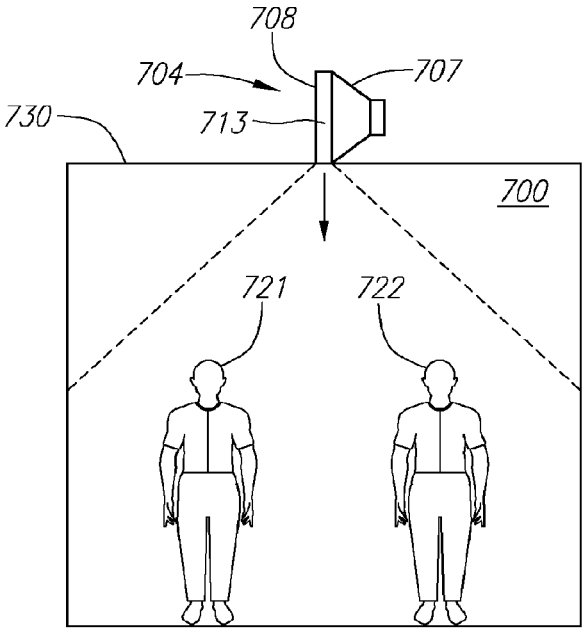
FIG. 7 is a diagram illustrating sound radiating from a slotted speaker unit into a room of listeners, according to a particular example.

Another embodiment of a narrow profile speaker unit 600 is illustrated in FIG. 6, which illustrates a side view of the speaker unit 600 (similar to FIG. 2B). In the example shown in FIG. 6, two speakers 604, 605 are positioned so as to face one another, while they share a common output slot 606 from which their sound radiates. A first mounting surface 602, adapted to receive first speaker 604, is positioned opposite a second mounting surface 603, adapted to receive second speaker 605. The first speaker 604 may, but need not, have identical audio characteristics to second speaker 605. The mounting surfaces 602, 603 define opposing sides of a sound duct 615 having an output slot (or other orifice) 606. A frammel 607, preferably having a non-resonant characteristic, is optionally disposed across the sound duct 615 between the speakers 604, 605, and preferably midway therebetween.

An audio input signal is preferably applied to both speakers 604, 605 simultaneously, such that the speakers 604, 605 simultaneously emit soundwaves towards one another, and against opposite sides of the frammel 607 (if any). As a result, longitudinal soundwaves having the combined power of the outputs of both speakers 604, 605 emanate from output slot 606, thus generating increased audio output, without necessarily requiring the use of a larger (and thus more expensive) driver as may be needed in a single-speaker configuration. If the same audio output signal is applied to both speakers 604, 605, the forces being generated against opposite sides of the frammel 607 will tend to cancel out. Because the output regions of the two speakers 604, 605 are so close together, the potential for undesirable lobing caused by destructive interference from multiple speakers is significantly reduced. By contrast, when the wavelength of the sound output approaches the center-to-center distance between two forward-facing speakers, lobing will tend to occur particularly at off-axis listening positions, but this effect is mitigated by the arrangement of speaker unit 600 in FIG. 6. The "lobeless" characteristic of speaker unit 600 makes it advantageous for use as, e.g., a center channel speaker unit. Moreover, the output slot 606 may generally remain of relatively narrow profile, despite the presence of two speakers 604, 605 which, if forward facing, would tend to occupy substantially more surface area in the direction of sound radiation. The speaker unit 600 of FIG. 6 may provide many of the same benefits of the speaker unit 100 shown in FIG. 1, with the additional benefit of increased sound output. Moreover, the speaker unit 600 may provide an exceptionally robust directional characteristic, with little drop off in volume or frequency response even at extreme angles of listening.

Figure 28A:
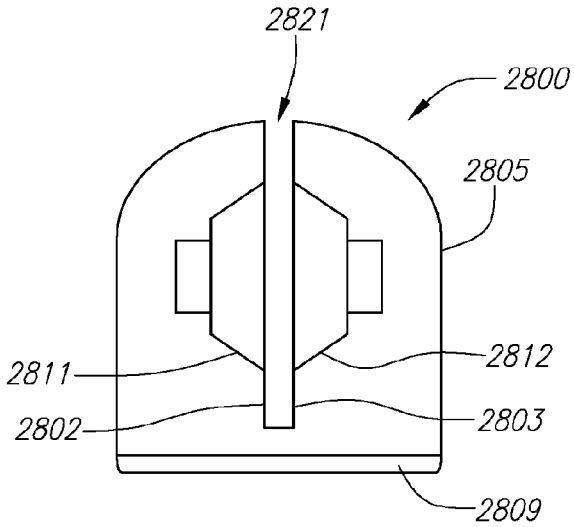
FIGS. 28A and 28B are a side view cross-sectional diagram and an oblique view diagram, respectively, of a speaker unit having a slot for sound output, in accordance with another embodiment as disclosed herein.
Figure 28B:
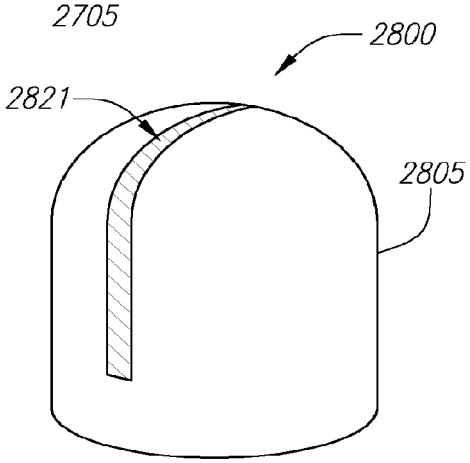

An example of an embodiment in general accordance with the principles described with respect to FIG. 6 is illustrated in FIGS. 28A and 28B, which show a side view in cross-section and an oblique view, respectively, of a speaker unit 2800 enclosing two speakers 2811, 2812 facing one another (although more than two speakers could be present in speaker unit 2800). The speaker unit 2800 comprises a housing 2805 which preferably encloses the speakers 2811, 2812. The speaker housing 2805 in the example illustrated in FIGS. 28A-28B is generally dome-shaped, as illustrated, and rests on a housing base 2809. The speakers 2811, 2812 are disposed on mounting surfaces 2802 and 2803, respectively, in a manner as previously described with respect to FIG. 6. The speaker housing 2805 has an output slot 2821 for sound radiation. The output slot 2821 generally wraps around both sides and the top of the speaker housing 2805, but may be shorter or longer depending upon, e.g., the desired area of sound dispersion or other factors (e.g., aesthetics). In one aspect, the speaker unit 2800 provides a relatively compact, self-contained, and unobtrusive sound output source, which may be conveniently placed on a desktop or shelf, for example, or may be integrated on or atop an electronic appliance.

Figure 15:
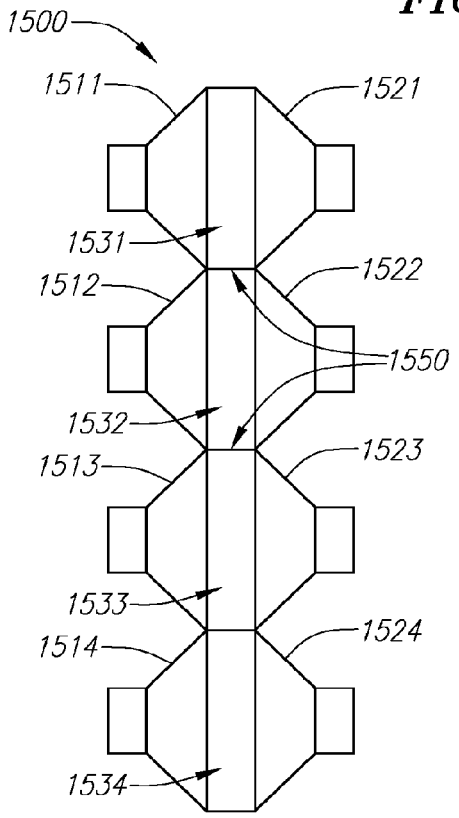
FIG. 15 is a diagram of a speaker arrangement including pairs of speakers facing one another, with sound output slot(s), in accordance with one embodiment as disclosed herein.

Another example of an embodiment in general accordance with the principles described with respect to FIG. 6 is illustrated in FIG. 15, which shows a front view of a speaker unit 1500 of multiple pairs of inline speakers facing one another. As illustrated in FIG. 15, there are four pairs of speakers "stacked" in a row, with speakers 1511, 1521 comprising a first pair, speakers 1512, 1522 comprising a second pair, speakers 1513, 1523 comprising a third pair, and speakers 1514, 1524 comprising a fourth pair. Each pair of speakers in FIG. 15 is configured in a manner similar to FIG. 6; that is, the speakers (e.g., 1511, 1521) are facing one another, with a sound output slot (e.g., 1531) therebetween for allowing radiation of the sound from the pair of speakers. The four output slots 1531, 1532, 1533, and 1534 for the four pairs of speakers collectively form an elongated sound output slot; the individual output slots 1531, 1532, 1533, 1534 may optionally be separated by walls 1550. While four pairs of speakers are illustrated in FIG. 15, the same principles of arrangement may be applied to any number of speaker pairs. The use of multiple speaker pairs, such as illustrated in FIG. 15, may provide increased sound output and may therefore be well suited to larger listening environments. At the same time, the speaker profile utilized for sound output may be relatively minimal—e.g., the collective elongate slot formed by output slots 1531, 1532, 1533, and 1534. Thus, the speaker arrangement of FIG. 15 may retain the advantage of providing a relatively unobtrusive and/or narrow profile speaker system, which allows relatively high sound output while providing the ability to conceal the speakers from view, or to provide other speaker packaging options that would otherwise be unavailable.

Figure 16:
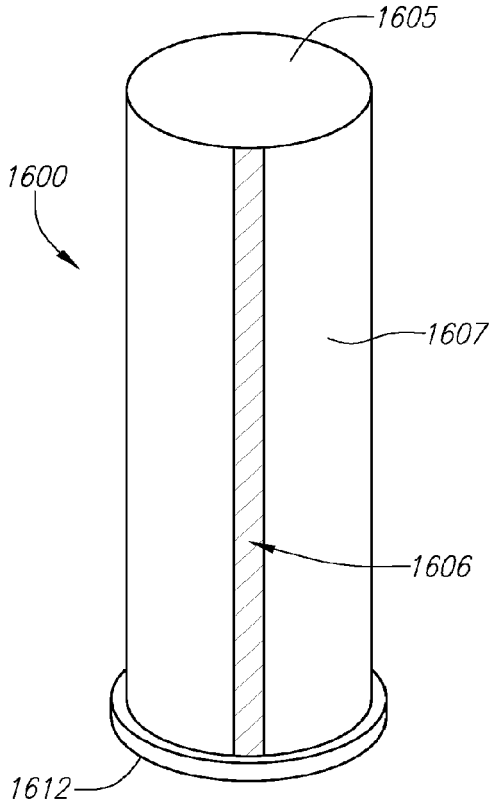
FIG. 16 is a diagram illustrating an example of a speaker enclosure which may incorporate a speaker arrangement such as illustrated, for example, in FIG. 15.

An example of one such speaker packing option is illustrated in FIG. 16, which depicts a speaker unit 1600 having a cylindrical housing 1607 that may enclose multiple pairs of speakers placed in the general configuration of, e.g., FIG. 15. In FIG. 16, the cylindrical housing 1607 may be placed upright on a surface (such as a room floor), and is securably attached to a housing base 1612, which provides a secure and stable footing for the speaker unit 1600. An elongate slot (or other orifice) 1606 is provided parallel with the center axis of the cylindrical housing 1607, and corresponds to the elongate slot collectively formed by output slots 1531, 1532, 1533 and 1534 shown in FIG. 15. The speaker housing 1607 need not have a grille as generally included with conventional speaker units, although a grille could optionally be used to cover output slot 1606. In addition to aesthetic advantages, and the advantages of having opposing speakers as described with respect to FIGS. 6 and 15, the speaker unit 1600 may also provide other potential advantages such as, e.g., resistance to weather, since the sound output region is relatively small as compared to conventional speaker units. The shape of the housing 1607 may vary; for example, it may be polygonal in shape, may be domed, or may have flat surfaces along the backsides of the speakers.

Figure 8:
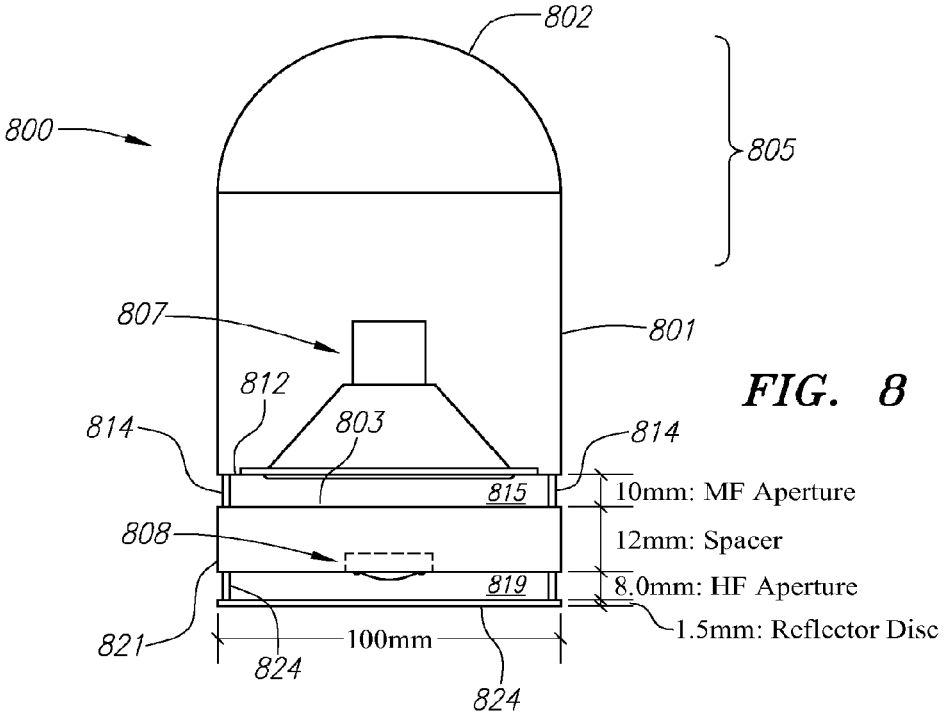
FIG. 8 is a cross-sectional side view diagram of a speaker unit having a sound output slot, according to another embodiment as disclosed herein.

Another speaker unit embodiment in accordance with various principles as described herein is illustrated in FIG. 8, which may be referred to as a ground plane speaker unit 800, as it may be particularly advantageous for, e.g., improving the sound quality of loudspeakers intended to be placed on a table, desk or similar reflecting surface that is relatively large compared to the wavelength of the radiated sound. The speaker unit 800 is depicted with a dome-shaped housing 805 which, in this example, is comprised of a cylindrical housing member 801 and a dome-shaped top housing member 802 attached to the cylindrical housing member 801, although both housing members 801, 802 may be integrated as a singular piece. The speaker unit 800, shown in cross-sectional side view in FIG. 8, includes a pair of speakers 807, 808—in this example, a first downward facing speaker 807 (preferably a mid-frequency driver having an operating range of about 200 Hz to 2 kHz) and a second downward facing speaker 808 (preferably a high-frequency driver, such as a domed tweeter, having an operating range of about 2 kHz to 20 kHz) disposed below the first speaker 807. The speaker 807 is mounted on a mounting surface 812, and faces a spacer 821 which provides a sound reflecting surface 803. The mounting surface 812 and sound reflecting surface 803 define a chamber or duct 815, similar to the speaker units described with respect to, e.g., FIGS. 1 and 4A-4B. Sound output from speaker 807 generally emanates perpendicular to the sound reflecting surface 803 and to the face of the speaker 807. Similarly, speaker 808 is oriented in a downwards direction, towards a housing base 824 (or other smooth surface) which acts as a sound reflecting surface, and defines a second chamber or duct 819 from which sound may emanate, generally perpendicular to the orientation of the downward-facing speaker 808. Speaker unit 800 thus has two annular output slots corresponding to ducts 815 and 819, one output slot for each speaker 807, 808.

The spacer 821 may have a top plate (not separately shown) of, e.g., particle board or MDF material, to provide a reflective surface for the top speaker 807, and may otherwise be comprised of any of a variety of materials or compositions, such as foam, polyurethane, silicone, composites, or other materials.

The speaker housing 805 may be connected to the spacer 821 via one or more strut(s) 814, in a manner similar to that described with respect to FIGS. 4A-4B. Likewise, the spacer 812 may be connected to the housing base 821 via one or more strut(s) 824, in a manner similar to that described with respect to FIGS. 4A-4B. As with the speaker unit shown in FIGS. 28A-28B, the speaker unit 800 of FIG. 8 may provide a relatively compact, self-contained, and unobtrusive sound output source, which may be conveniently placed on a desktop or shelf, for example, or may be integrated on or atop an electronic appliance.

Figure 10A:
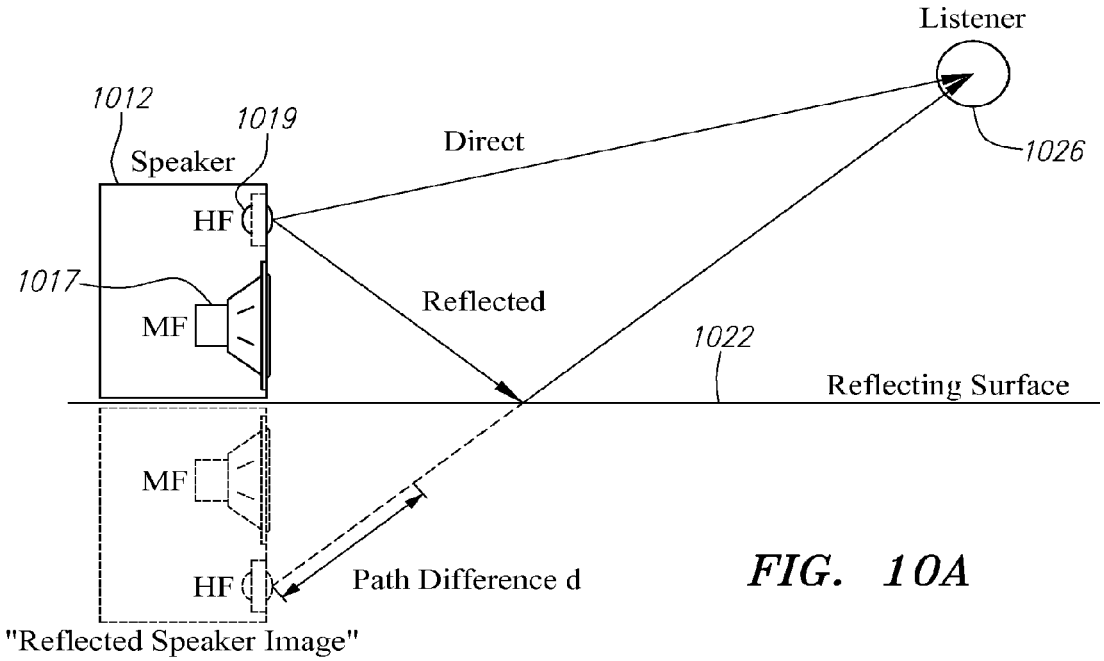
FIGS. 10A and 10B are diagrams comparing the radiance of sound from a ground plane speaker unit constructed in accordance with the principles illustrated in FIG. 8, with a conventional speaker unit.
Figure 10B:
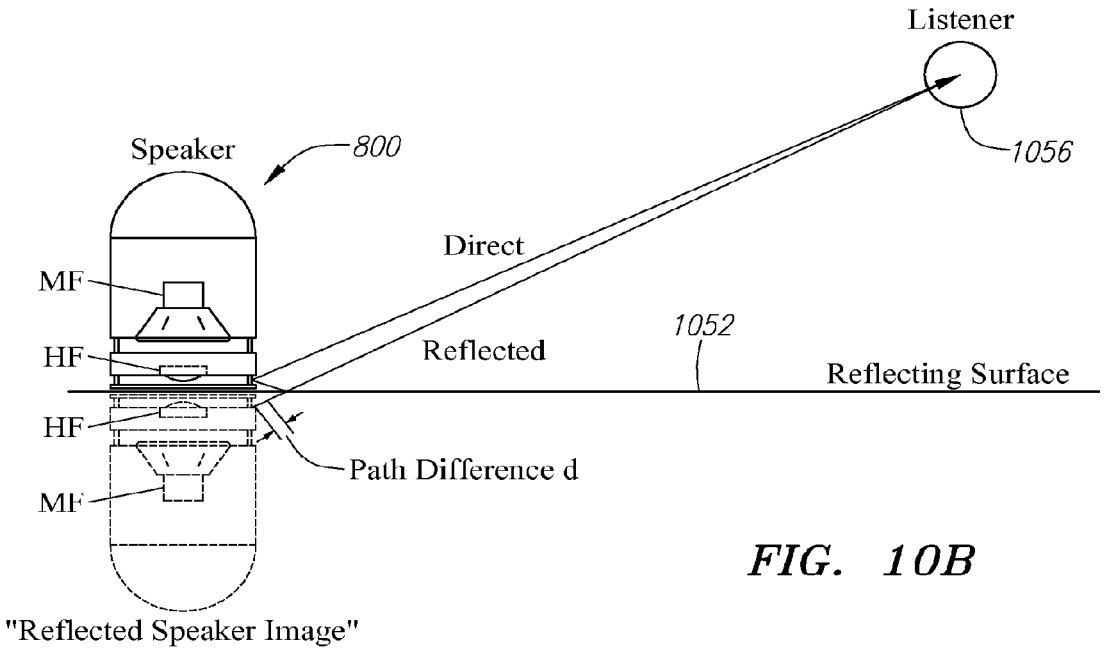

A speaker unit 800 configured in accordance with the principles of FIG. 8 may provide improved listening experience in a variety of circumstances. FIGS. 10A and 10B are illustrations comparing the radiance of sound from a ground plane speaker unit 800 constructed in accordance with the principles of FIG. 8, with a conventional two-way speaker unit 1012. With a conventional two-way speaker unit 1012, a high frequency driver 1019 is often placed above a mid-frequency driver 1017 within the speaker enclosure. When the speaker 1012 is placed on a surface (particularly a highly reflective surface such as a desktop, or a hard floor) 1022, a listener (represented by point 1026 in FIG. 10A) generally experiences both a direct sound output from the speakers 1017, 1019 as well as a reflected sound output caused by the surface 1022. It can be seen from FIG. 10A that there will be a differential time delay due to the path difference between the direct sound and the first reflection. For differential delay times comparable with the period of the signal frequency, the resulting phase differences are sufficient to cause destructive interference between the direct and reflected sound spectra often referred to as "comb filtering." The resulting spectral distortions can impart a roughness or coloration to the perceived sound quality. Comb filtering effects can be lessened by raising the speakers above the desk on a stand, but the benefit of this adjustment is generally offset by the loss in low frequency output since useful reinforcement of the low frequencies that would otherwise be provided by the reflecting surface 1022 is reduced.

By contrast, as illustrated in FIG. 10B, a speaker unit 800 in accordance with the embodiment illustrated in FIG. 8 may retain low frequency enhancement while avoiding comb filtering effects. In the arrangement of FIG. 8, the differential time delay may be sufficiently reduced to avoid destructive interference over the whole of the audio band, improving the sound qualify from the standpoint of a typically positioned listener 1056. The mid-frequency driver 807 is sufficiently close to the reflecting surface 1052 that low frequency boost is retained, and the radiating apertures defined by ducts 815, 819 are preferably close enough to the sound reflecting surface 1052 that an interfering phase shift between the direct and reflecting soundwaves is not induced. In addition, the speaker unit 800 of FIG. 8 may possess an extremely broad directional characteristic over the frequency range for which the wavelength of sound in air is large compared with the slot dimensions.

In variations of the embodiment shown in FIG. 8, the speaker housing 805 need not be dome-shaped but may take on a variety of other shapes; for example, it may be cylindrical, pyramidal (including in the shape of a wide obelisk), or polygonal. The speaker unit 800 may also be oriented in a different direction; for example, it may be oriented upwards, with the speaker housing 805 suitably shaped to provide a stable base surface. As illustrated in the example of FIG. 8, the width of the aperture or gap defined by duct 819 for the high frequency driver (speaker 808) may be narrower than the width of the aperture or gap defined by the duct 815 for the mid-frequency driver (speaker 807). However, while exemplary dimensions are illustrated in FIG. 8 for the width of the ducts 815 and 819 (10 and 8 millimeters respectively), and for the width of the spacer 821 (12 millimeters), these dimensions are by no means are intended to be limiting, but are merely exemplary.

Figure 9A:
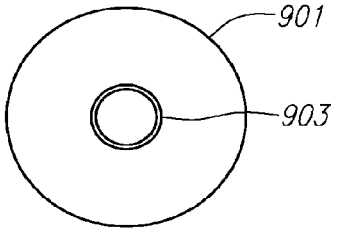
FIGS. 9A through 9E are top view cross-sectional diagrams illustrating various arrangements of relative speaker locations and sound damping material, as may be used in connection with the speaker unit illustrated in FIG. 8.
Figure 9B:
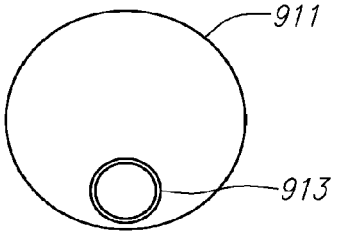
Figure 9C:
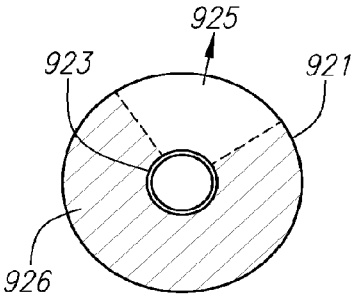
Figure 9D:
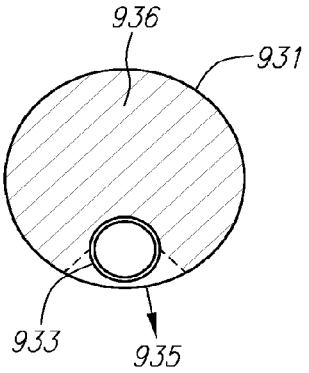
Figure 9E:
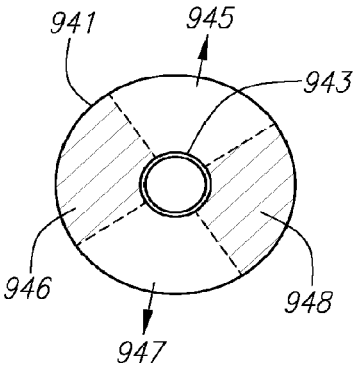

In other variations of the speaker unit 800 illustrated in FIG. 8, the position of the second speaker 808 may be varied, and/or sound damping material may be used to, e.g., control the directivity of the sound output from the second speaker 808. FIGS. 9A through 9E are top view cross-sectional diagrams illustrating various arrangements of relative speaker locations and sound damping material, as may be used in connection with the speaker unit illustrated in FIG. 8. FIG. 9A is a bottom view illustrating a situation in which the lower speaker 808 (illustrated as 903 in FIG. 9A) is centrally disposed within spacer 821 (illustrated as 901 in FIG. 9A), much as shown in and described with respect to FIG. 8. FIG. 9B illustrates a similar configuration but with the lower speaker 913 off-set from the center axis of the spacer 911. FIG. 9C is similar to FIG. 9A, with the lower speaker 923 centrally disposed with respect to spacer 921, but sound damping material 926 is added in duct 819 such that sound is output through a slot or aperture 925. FIG. 9D is similar to FIG. 9B, with the lower speaker 933 offset from the center axis of spacer 931, but sound damping material 936 is added in the duct (as with FIG. 9C) such that sound is output through a slot or aperture 935. FIG. 9E is similar to FIG. 9C, with the lower speaker 943 centrally disposed with respect to spacer 941, but sound damping material 946, 948 has been added such that two output slots or apertures 945, 947 are defined through with sound from the speaker 943 may be output. Thus, placement of the lower speaker 808 may be varied, and/or sound damping material added to provide various sound output strategies.

The speaker unit 800 illustrated in FIG. 8, and its other variations as described herein, may be useful in a variety of applications in addition to desktop or floor standing loudspeakers. For example, such a speaker unit may be used in recording studios to avoid undesired sound reflections and interference from a mixing desk. The speaker unit may be mounted to a wall or ceiling, in the manner of a smoke alarm, providing exceptional omnidirectional sound quality but with an unobtrusive appearance. The speaker unit could also be used on electronic appliances, such as attached to a plasma or flatscreen television monitor, or a desktop computer monitor, or the like.

Various embodiments as disclosed herein pertain to narrow profile speaker arrangements in which two (or possibly more) speakers are placed side-by-side or in near proximity. Examples of such embodiments are illustrated in, e.g., FIGS. 11, 12B, and 19A, and elsewhere herein. In some of these embodiments, it is possible, with suitable sound processing of left and right audio input signals, to achieve a spreading of the sound image to produce a stereo-like quality despite the fact that the speakers may be closely spaced. Such speaker systems may find useful application in a variety of environments, such as, e.g., automobiles or desktop computers.

Figure 12A:
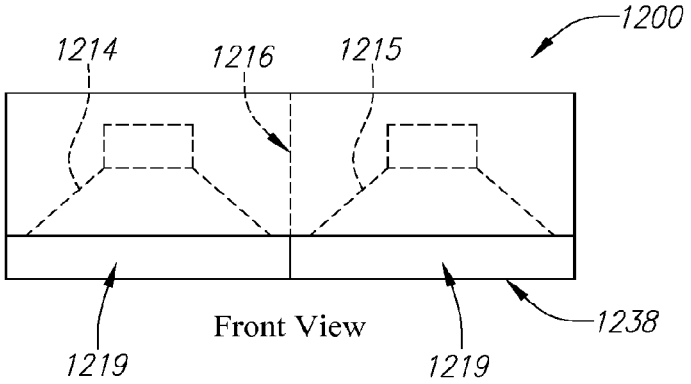
FIG. 12A is a front cut-away view of an embodiment of a speaker enclosure for a pair of stereo speakers.
Figure 12B:
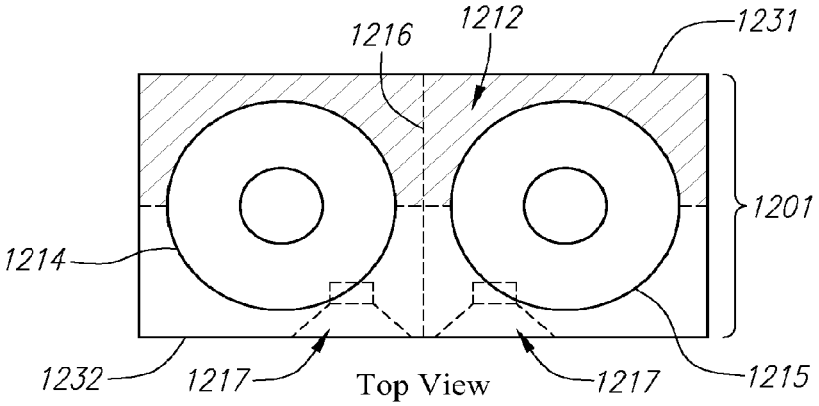
FIG. 12B is a top cross-sectional view diagram of the speaker enclosure shown in FIG. 12A.
Figure 12C:
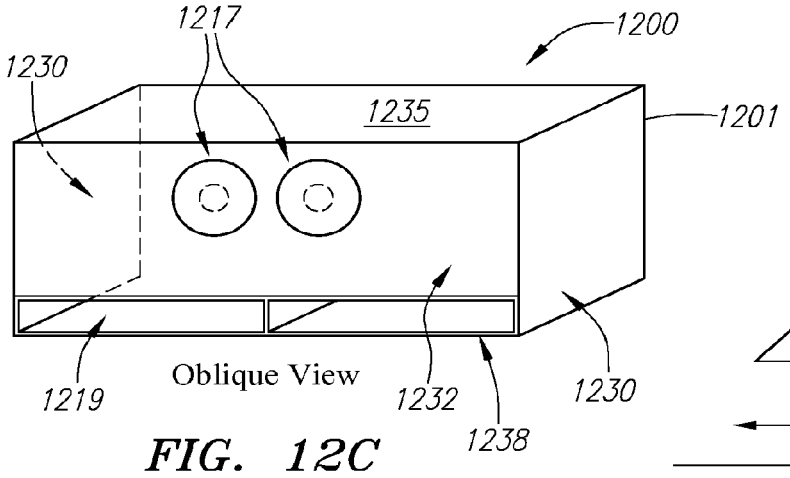
FIG. 12C is an oblique front view diagram of the speaker enclosure shown in FIGS. 12A and 12B.

When a pair of speakers are closely spaced, they may be placed on a common mounting structure—for example, in a common enclosure, with a central (preferably airtight) dividing partition—that may, for example, be inserted into or else integral with the front console or dashboard of an automobile, or placed elsewhere near the central axis of the automobile, or placed in a suitable location in another confined space or listening environment. FIGS. 12A, 12B and 12C illustrate one example of an enclosure 1201 as part of a speaker system 1200, particularly suited to applications where space is limited, housing a pair of speakers 1214, 1215 which can receive and respond to sound processed signals from left and right audio channels in accordance with the various techniques described elsewhere herein. FIG. 12A is a front cut-away view of the exemplary speaker enclosure 1201 housing the pair of speakers 1214, 1215; FIG. 12B is a top cross-sectional view of the speaker enclosure 1201 shown in FIG. 12A; and FIG. 12C is an oblique front view of the speaker enclosure 1201 shown in FIGS. 12A and 12B. As shown perhaps best in FIG. 12C, the speaker enclosure 1201 in this example is preferably substantially rectangular in shape, and, where configured for an automobile, is preferably designed with dimensions so as to slide into or otherwise fit within a standard or double "DIN" slot in the front console space of an automobile. The speaker enclosure 1201 may include a front panel 1232, a pair of side panels 1230, a top panel 1235, a bottom panel 1239, and possibly a back panel 1231. To achieve isolation between the two speakers 1214, 1215, an interior wall 1216 such as illustrated in FIGS. 12A and 12B may be placed between the speakers 1214, 1215, thus creating two separate speaker chambers, one housing each of the two speakers 1214, 1215. The speakers 1214, 1215 are preferably positioned or mounted on a baffle, a mounting surface, or other barrier so as to acoustically isolate their rear radiation from their front radiation.

The pair of speakers 1214, 1215 may be oriented with the speaker faces directed frontwards; however, in the instant example, the speakers 1214, 1215 are oriented downwards, as illustrated in FIG. 12A. When so oriented, a slot (or other orifice) 1219 may be located at the bottom of the speaker enclosure 1201, to allow the sound from the speakers 1214, 1215 to radiate outwards towards the direction of the listeners in the automobile. Effectively, then, the speakers 1214, 1215 only take up an amount of console/dash surface space corresponding to the size of the slot 1219. In an automobile environment, front console/dash space is typically extremely valuable since it is scarce, and thus the ability to position two speakers 1214, 1215 in the front console/dash while minimizing the amount of surface space consumed can be quite advantageous. Audio system controls/display(s) or other conventional console accouterments (controls, LCD or other displays, air vents, etc.) can be attached to or integral with the front panel 1232 of the speaker enclosure 1201, so the available surface space on the front panel 1232 is valuably utilized.

Moreover, when oriented in the manner described above, the speakers 1214, 1215 may be potentially larger in size (assuming console space is limited); for example, each speaker may be about 4" (for a total of approximately 8" across collectively), which may fit into a standard DIN space or other similar space, whereas the speakers would otherwise generally have to be under perhaps 2" to 2½" or less to fit within the DIN space (or other similar center console space), if oriented in a frontwards direction. The ability to place larger speakers in the center speaker unit may, among other advantages, allow better bass reproduction then would be the case with smaller centrally located speakers and, hence, can reduce or potentially dispense with the need for side (e.g., door-mounted) bass speakers to carry the bass information of the left and right channels.

Figure 12D:
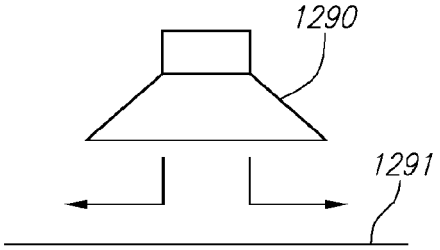
FIG. 12D is a diagram illustrating sound reflection from a downward oriented speaker, such as a speaker in the speaker enclosure of FIGS. 12A-12C.

The effect of orienting the speakers 1214, 1215 in a downward direction is conceptually illustrated in FIG. 12D, which shows a generic speaker 1290 pointing downwards towards a surface 1291. The sound output from the speaker 1290 radiates outward from the centerpoint along the surface 1291 in essentially all directions (i.e., a complete 360-degree circle). Thus, as shown in FIGS. 12A and 12C, a slot 1219 is preferably located at the bottom of the speaker enclosure 1201, to allow the sound from the speakers 1214, 1215 to radiate outwards towards the direction of the listeners in the automobile. A layer of insulation 1212 (e.g., foam or other sound-damping material) matching the outer contours of the speakers 1214, 1215, as illustrated in FIG. 12B or in other embodiments as shown elsewhere herein, may be placed within the speaker enclosure 1201, so that the sound does not reflect on the back panel 1231 (if any) of the speaker enclosure. In the resulting speaker enclosure configuration, sound emanating from the speakers 1214, 1215 is cleanly projected through the slot 1219 to the listeners in the automobile.

The layer of insulation 1212 may have the benefit(s) in certain embodiments of preventing the creation of standing waves, and/or of minimizing the variation of sound output response with respect to frequency so that the speaker output can be readily equalized by, e.g., any standard techniques, including analog or digital equalization. For example, cascaded filter sections may be employed to tailor the frequency response of the speakers 1214, 1215 in discrete frequency bands so as to provide a relatively uniform overall frequency response.

The layer of insulation 1212 may be comprised of any suitable material, preferably non-resonant in nature and having sound damping or absorbing qualities. The insulation 1212 may, for example, be comprised of expanded or compressed foam, but may alternatively comprise rubber, reinforced paper, fabric or fiber, damped polymer composites, or other materials or composites.

In an alternative embodiment, the speakers 1214, 1215 may be directed upwards instead of downwards, with the slot 1219 being located at the top of the speaker enclosure 1201, to achieve a similar effect. The speakers 1214, 1215 may alternatively be positioned sideways, either facing towards are away from each other, with a pair of slots (one for each of the speakers 1214, 1215) being adjacent and vertical in orientation rather than horizontal, as with slot 1219. In such an embodiment, the speaker enclosure may be taller but narrower in size.

In some circumstances, high frequencies (such as over 2 KHz) might become lost or reduced in the speaker enclosure configuration illustrated in FIGS. 12A-12C. Therefore, one or more additional speakers 1217 of small size (e.g., tweeters) may be advantageously placed above the "bell" of the speakers 1214, 1215 and in the front panel 1232 of the speaker enclosure 1201, to radiate the higher frequencies.

Figure 14:
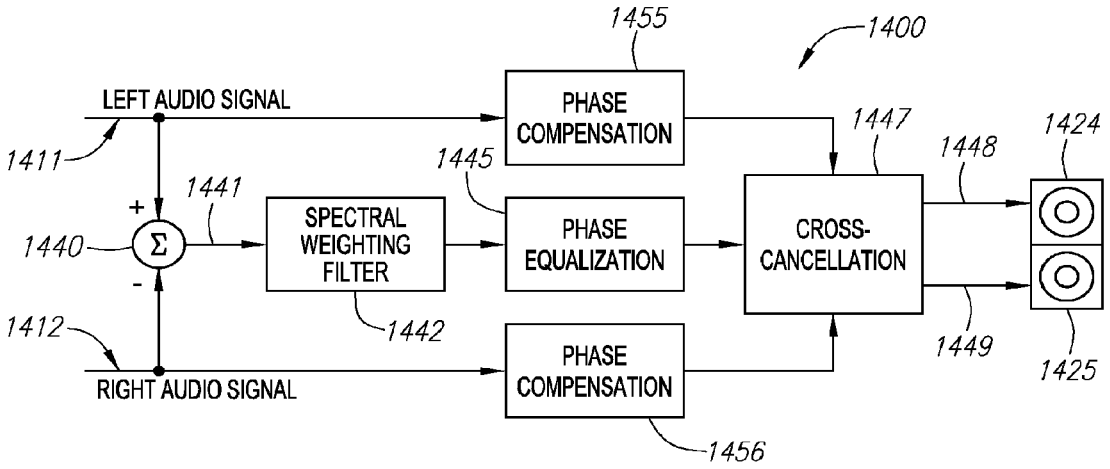
FIG. 14 is a simplified block diagram of a sound processing system in accordance with one or more embodiments as disclosed herein.

FIG. 14 is a block diagram of a sound processing system 1400 as may be used, for example, in connection with the speaker system 1200 illustrated in FIGS. 12A-12D, or more generally in other sound systems which utilize multiple audio channels to provide stereo source signals to closely spaced speakers. In the sound processing system 1400 of FIG. 14, a left audio signal 1411 and right audio signal 1412 are provided from an audio source and processed to provide left and right output signals 1448, 1449 for closely spaced speakers 1424, 1425, and may be fed to other speakers as well (not shown in FIG. 14). A difference between the left audio signal 1411 and right audio signal 1412 is obtained by, e.g., a subtractor 1440, and the difference signal 1441 is preferably fed to a spectral weighting filter 1442, which applies a spectral weighting (and possibly a gain factor) to the difference signal 1441. The characteristics of the spectral weighting filter 1442 may vary depending upon a number of factors including the desired aural effect, the spacing of the speakers 1424, 1425 with respect to one another, the taste of the listener, and so on. The output of the spectral weighting filter 1442 may be provided to a phase equalizer 1445, which compensates in part for the phase shifting effect caused by the spectral weighting filter 1442 (if non-linear).

The output of the phase equalizer 1445 in FIG. 14 is provided to a cross-cancellation circuit 1447. The cross-cancellation circuit 1447 also receives the left audio signal 1411 and right audio signal 1412, as adjusted by phase compensation circuits 1455 and 1456, respectively. The phase compensation circuits 1455, 1456, which may be embodied as, e.g., all-pass filters, shift the phase of their respective input signals (i.e., left and right audio signals 1411, 1412) in a complementary manner to the phase shifting performed by the phase equalizer 1445 (and the inherent phase distortion caused by the spectral weighting filter 1442). The cross-cancellation circuit 1447, which may include a pair of summing circuits (one for each channel), then mixes the spectrally-weighted, phase-equalized difference signal, after adjusting for appropriate polarity, with each of the phase-compensated left audio signal 1411 and right audio signal 1412. The perceived width of the soundstage produced by the pair of speakers 1424, 1425 can be adjusted by varying the gain of the difference signal path, and/or by modifying the shape of the spectral weighting filter 1442.

Figure 29:
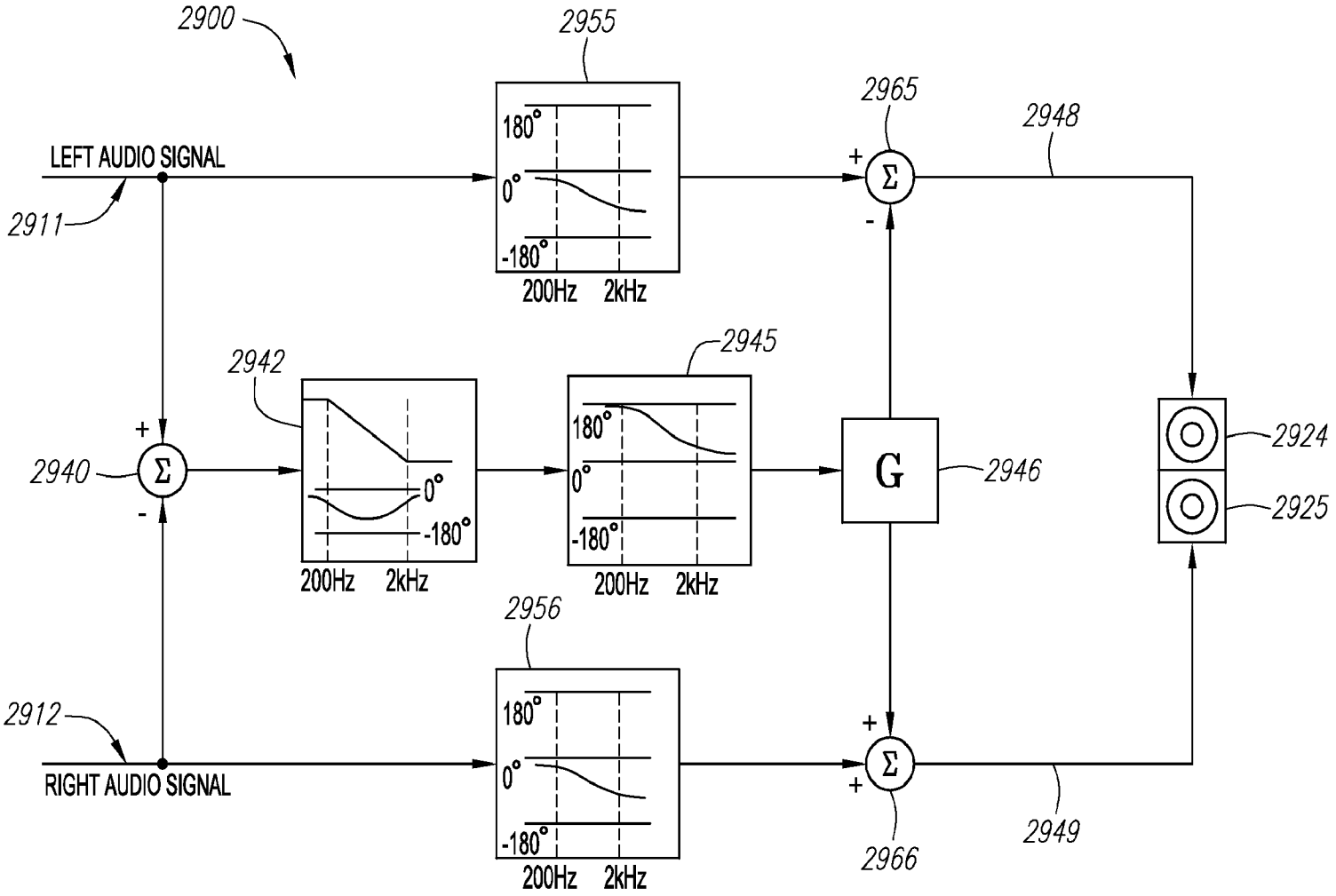
FIG. 29 is a diagram of a sound processing system generally in accordance with various principles described with respect to FIG. 14, and showing examples of possible transfer function characteristics for certain processing blocks.

FIG. 29 is a diagram of a sound processing system 2900 in general accordance with the principles and layout illustrated in FIG. 14, having a pair of closely spaced speakers 2924, 2925, and further showing typical examples of possible transfer function characteristics for certain processing blocks. As with FIG. 14, in the sound processing system 2900 a left audio signal 2911 and a right audio signal 2912 are provided from an audio source (not shown), and a difference signal 2941 is obtained representing the difference between the left audio signal 2911 and the right audio signal 2912. The difference signal 2941 is fed to a spectral weighting filter 2942, which, in the instant example, applies a spectral weighting to the difference signal 2941, the characteristics of which are graphically illustrated in the diagram of FIG. 29. A more detailed graph of the transfer function characteristics (both gain and phase) of the spectral weighting filter 2942 in this example appears in FIG. 30A. As shown therein, the spectral weighting filter 2942 is embodied as a first-order shelf filter with a gain of 0 dB at low frequencies, and turn-over frequencies at approximately 200 Hz and 2000 Hz. If desired, the gain applied by gain/amplifier block 2946 can be integrated with the spectral weighting filter 2942, or the gain can be applied downstream as illustrated in FIG. 29. In any event, the turn-over frequencies, amount of gain, slope, and other transfer function characteristics may vary depending upon the desired application and/or overall system characteristics.

A phase equalizer 2945 is provided in the center processing channel, and addition phase compensation circuits 2955 and 2956 in the right and left channels, to ensure that the desired phase relationship is maintained, over the band of interest, between the center channel and the right and left channels. As shown graphically in both FIG. 29 and in more detail in FIG. 30A, the spectral weighting filter 2942 in the instant example causes a phase distortion over approximately the 200 Hz to 2000 Hz range. The phase equalizer 2945 provides no gain, but modifies the overall frequency characteristic of the center channel. The phase compensation circuits 2955 and 2956 likewise modify the phase characteristics of the left and right channels, respectively. The phase compensation is preferably selected, in the instant example, such that the phase characteristic of the center channel (that is, the combined phase effect of the spectral weighting filter 2942 and the phase equalizer 2945) is approximately 180° out-of-phase with the phase characteristic of the left and right channels, over the frequency band of interest (in this example, over the 200 Hz to 2000 Hz frequency band). At the same time, the phase characteristic of the left and right channels are preferably remains the same, so that, among other things, monaural signals being played over the left and right channels will have identical phase processing on both channels (and thus maintain proper sound characteristics). Therefore, the phase compensation circuits 2955 and 2956 preferably are configured to apply identical phase processing to the left and right channels.

Figure 30B:
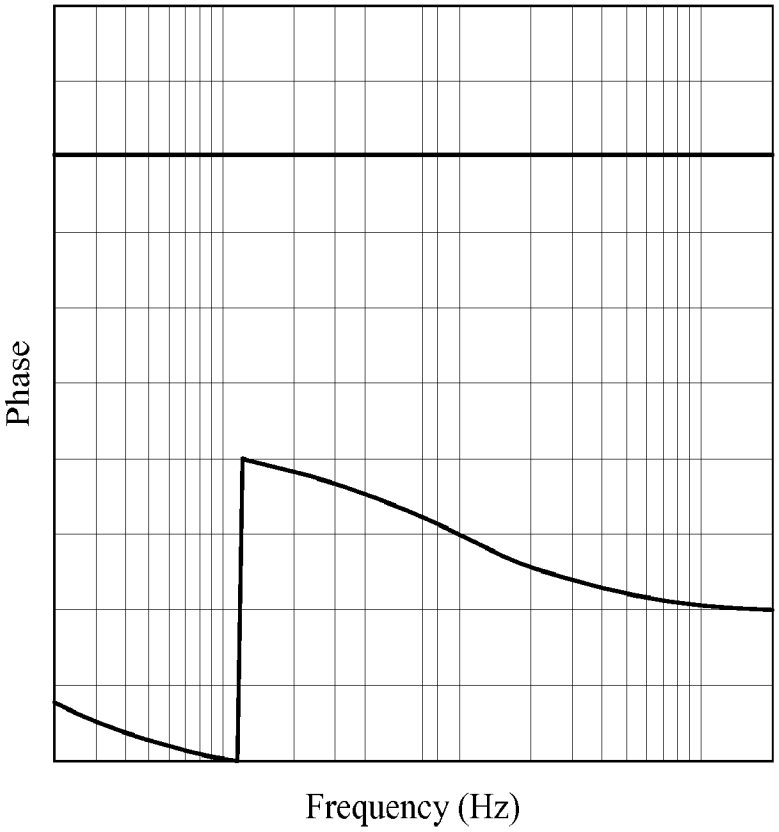
FIGS. 30A-30C are graphs illustrating examples of gain and/or phase transfer functions for a sound processing system in accordance with FIG. 29.
Figure 30A:
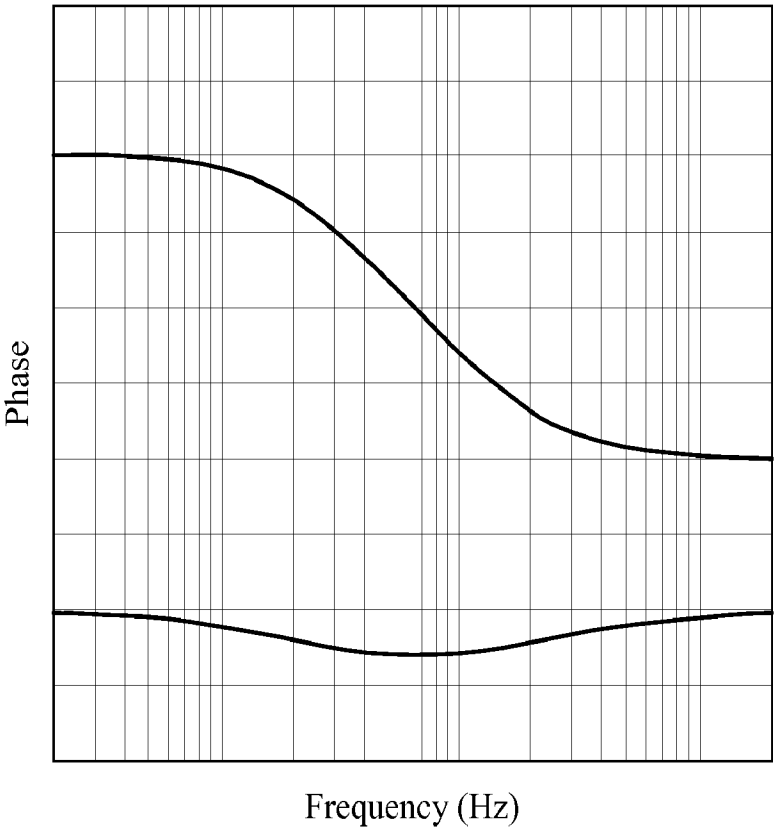
Figure 30C:
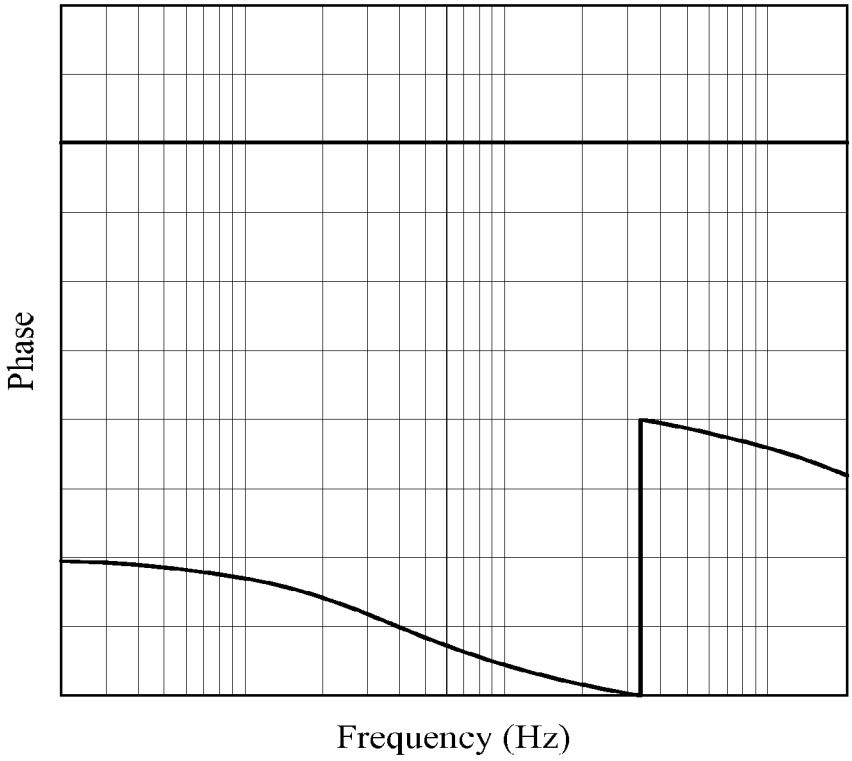

More detailed graphical examples of gain and phase transfer functions (with the gain being zero in this case when the components are embodied as all-pass filters) are illustrated for the center channel phase equalizer 2945 in FIG. 30B and for the left and right channels phase compensation circuits 2955, 2956 in FIG. 30C. In these examples, the phase equalizer 2945 is embodied as a second-order all-pass filter (with F=125 Hz and Q=0.12), and the phase compensators 2955, 2956 are each embodied as second-order all-pass filters (with F=3200 Hz and Q=0.12). A higher Q value may be used to increase the steepness of the phase drop-off, reducing the extent to which the center channel is out-of-phase with the left and right channels at low frequencies (thus minimizing the burden imposed upon the speakers 2924, 2925).

The sound processing systems 1400 and 2900 of FIGS. 14 and 29 may provide certain benefits, such as a broadened sound image, when used in connection with two closely spaced speakers such as illustrated in FIGS. 12A-12C. Also, while the speaker enclosure 1201 shown in FIGS. 12A-12C has certain advantages for placement in a standard DIN space (or other similar or analogous space) of an automobile, it should be understood that the closely spaced speakers 1214, 1215, whether or not contained in a speaker enclosure 1201, may be positioned in other areas of the automobile as well, such as atop the front dashboard, above the rear seatback, or in a center console or island located between the front seats or between the front and back seats. Preferably, the closely spaced speakers 1214, 1215 are located on or near the center axis of the automobile, so as to provide optimal sound quality evenly to occupants on both sides.

Because of space constraints within an automobile, centrally located speakers may have to be of limited size. Smaller speakers, however, tend to suffer losses at low frequencies. To compensate for the loss of low frequency components where the central pair of speakers are small, left and right bass speakers may be provided in a suitable location—for example, built into the automobile doors. The left and right audio channels fed to the left and right door speakers can be processed to attenuate the mid/high frequencies and/or boost the bass audio components. Providing bass frequencies through the door speakers will not destroy the stereo effect of the mid/high frequencies provided by the central pair of speakers, since low frequencies are not normally localized by the human listener. In addition, a sub-woofer may be added in a suitable location within the automobile to further enhance very low frequency bass audio components. The sub-woofer may be located, for example, in the rear console of the car above the rear seatback, or in any other suitable location.

Various modifications may be made to provide even further improved sound for passengers in the back seat area. For example, a similar pair of closely spaced speakers to those placed in the front console or area can also be placed in the rear of the automobile, for example, atop the rear seatback on or in the rear parcel shelf, or at the back structure of the center island or console/armrest between the driver and passenger seats. The same signals that are used to feed the front pair of closely spaced speakers can be used to feed the rear pair of closely spaced speakers. If desired, a speaker enclosure 1201, such as shown in FIGS. 12A-12C, containing the pair of closely spaced speakers may be placed in the rear of the vehicle to house these rear speakers.

In certain applications, it may be desirable to provide surround sound or other multi-channel capability in a vehicular automotive system, in conjunction with a closely spaced speaker arrangement such as described previously herein. For example, a van, SUV or other large vehicle may have a DVD system which allows digital audio-visual media to be presented to the passengers of the vehicle, with the sound potentially being played through the vehicle audio system. In other cases, it may be desirable to allow for extreme right and left directional sound, which may originate by the existence of left and right surround channels on the recorded medium, or simply by the presence of an extreme and intentional disparity in the relative volumes of the left and right channel.

Figure 23A:
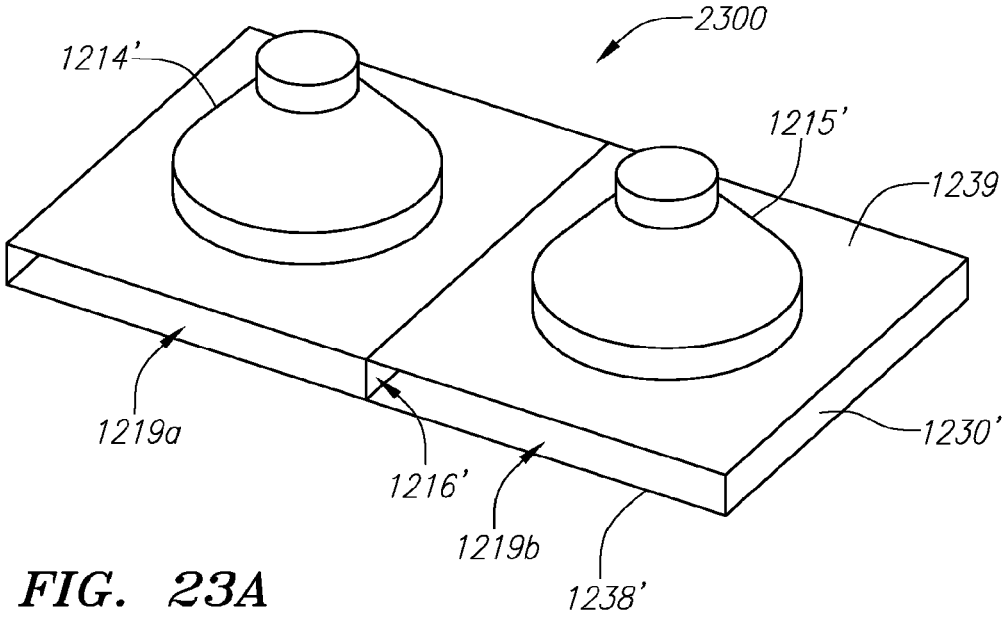
FIGS. 23A and 23B are oblique view diagrams comparing speaker mounting structures utilizing the general speaker arrangements of FIGS. 12A-12B and 19A-19B, respectively.

The mounting structure for the closely spaced speakers may take any of a wide variety of forms. In general, any mounting structure that provides adequate support for the closely spaced speakers (and possibly other components, including additional speakers, discrete electrical components, and/or printed circuit board(s)) and which forms a relatively narrow or constrained orifice for sound output from the closely spaced speakers may be utilized in the various embodiments as described herein. FIG. 23A, for example, is a diagram of a speaker mounting structure as may, for example, be used in connection with the speaker enclosure 1200 illustrated in FIGS. 12A-12D, or else in other arrangements. In FIG. 23A, speakers 1214' and 1215' (which are generally analogous to speakers 1214 and 1215 illustrated in FIG. 12A) are mounted on a baffle comprising a speaker mounting plate 1239 which, in this example, forms a top surface of sound ducts or channels associated with speakers 1214' and 1215', respectively. Along with the speaker mounting plate 1239, a sound reflecting plate 1238', side plates 1230', an optional center divider 1216', and a back plate (not shown) generally define the sound ducts or channels which output sound from slots 1219*a* and 1219*b*. The baffle (speaker mounting plate 1239) serves to reduce interference between sound radiated from the front and rear of the speakers 1214', 1215'. As indicated previously, with respect to, e.g., FIG. 12B, compressed or expanded foam, or other sound-damping material, may be placed within portions of the sound ducts to help guide the sound output in the desired direction while reducing undesirable artifacts and acoustic interference.

In certain applications, it is preferred that the other interior surfaces of top plate 1239, bottom plate 1238' or side plates 1230' are constructed of a rigid and substantially non-resonant material such as molded or high-impact plastic, pressed steel, aluminum, ceramics, and the like, or composite materials such as mica- or glass-reinforced plastic. The top plate 1239, bottom plate 1238' and side plates 1230' are preferably thin to minimize the space needed for the speaker unit assembly 2300. Likewise, the center divider 1216', if provide, may also be constructed of a rigid and substantially non-resonant material.

Figure 19A:
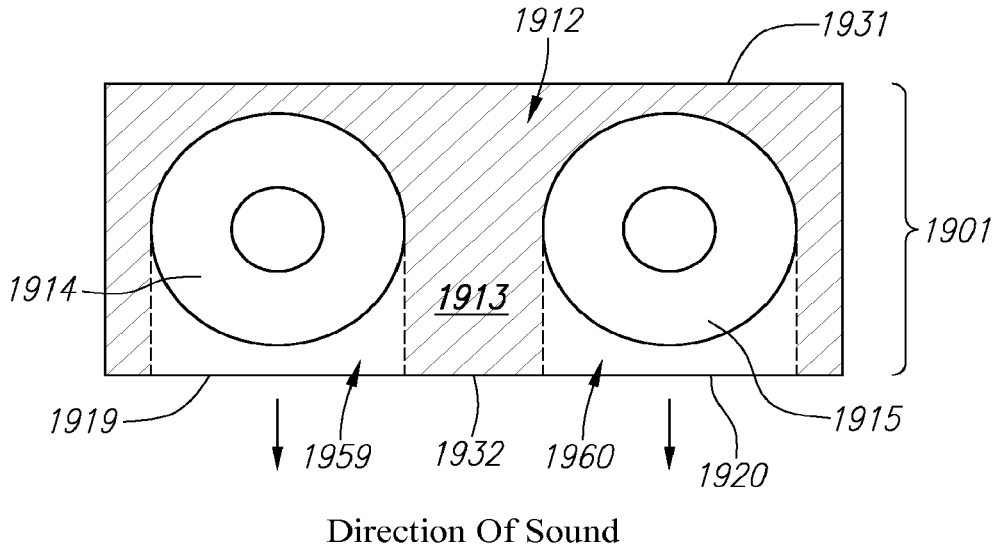

The rigid and substantially non-resonant interior surfaces of the sound ducts or channels are helpful in propagating the acoustic waves generated by speakers 1214', 1215' through the ducts or channels and out of output slots 1219*a* and 1219*b* while minimizing losses due to absorption, but may also in some cases cause undesirable interference, cancellation, standing waves, or acoustic artifacts. The embodiment illustrated in FIG. 19A may mitigate these potential problems. FIG. 19A is a cutaway top view diagram of a speaker mounting structure, similar in certain respects to FIG. 12B. As shown in FIG. 19A, sound-damping material 1912 is extended to the front 1932 of the speaker mounting structure 1901, thereby forming sound ducts 1959, 1960 associated with each of the two speakers 1914, 1915.

Figure 19B:
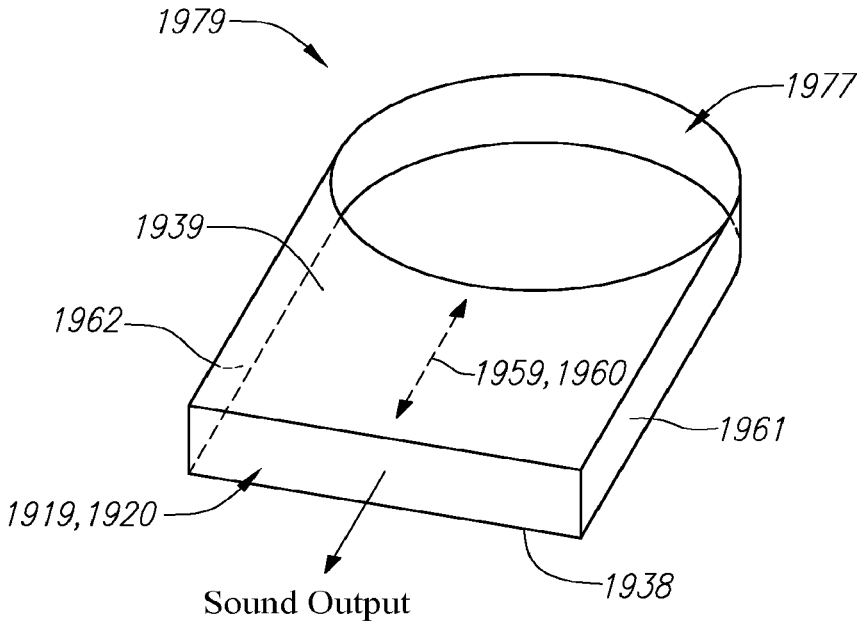
FIG. 19B is a detail diagram of a portion of FIG. 19A.

FIG. 19B shows the general dimensions of sound duct 1959 or 1960, with portions of the speaker mounting plate 1939 and sound reflecting plate 1938 defining two surfaces of the sound duct 1959 or 1960, and two sides 1961, 1962 of the sound duct 1959 or 1960 being defined by the edge of the sound-damping material 1912 (shown in FIG. 19A). An opening in the speaker mounting plate 1939 (i.e., baffle) permits placement of the speaker 1914 or 1915 thereon. In one aspect, the sound duct 1959 or 1960 effectively "turns" the sound output by the speaker 1914 or 1915 by 90° (in this example), so that the sound is carried to the output slot and released while retaining a sufficient degree of sound quality, and, similar to a number of other embodiments described herein, modifies the effective shape of the speaker output from an elliptical or circular radiator to a rectangular radiator. In addition, the total radiating surface area can be advantageously reduced, as compared to the radiating surface area of the speakers themselves, minimizing the space needed in the vehicle dash or other locations of the vehicle or other environment. Moreover, the aspect ratio of the output slot can be adjusted or tailored to modify the directional characteristic of the acoustic output in order to, for example, make the sound image broader along a particular axis, thus improving sound quality at off-axis listening positions.

The sound duct(s) 1959, 1960 may, in alternative embodiments, be slightly or moderately ascending or descending, or else the passage or duct may be semi-curved, such that the direction of the sound output is modified. Also, in various embodiments, the output slot may flare outwards or else may have other variations in size, shape (e.g., may be ovoid), and uniformity.

Figure 11:
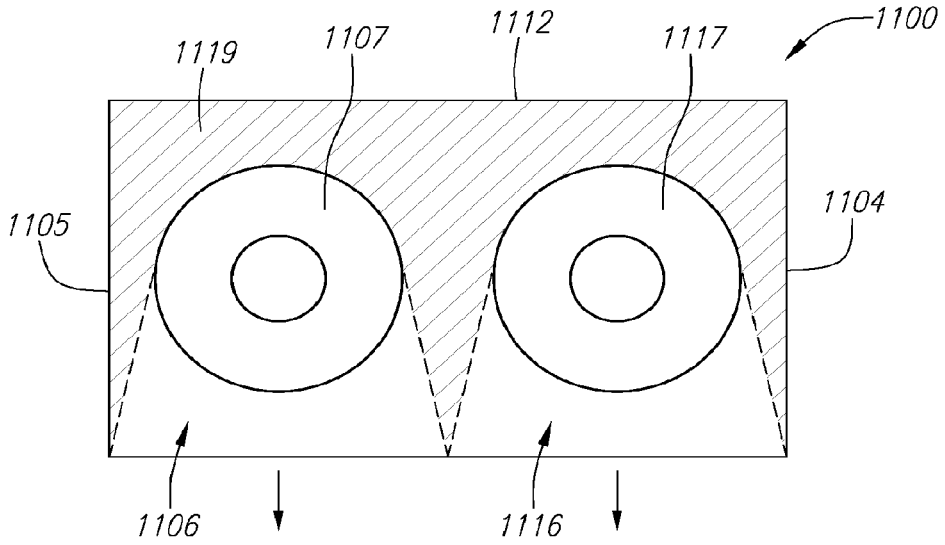
FIG. 11 is a diagram of a speaker unit having multiple speakers, with sound output slot(s).

As illustrated in FIGS. 19A and 19B, the sound ducts 1959, 1960 may be of substantially the same width as the cones of the speakers 1914, 1915, and may provide a superior mechanism for transporting the acoustical output of the speakers 1914, 1915 through the output slots 1919, 1920, respectively, as compared, for example, with a rectangular duct having only hard and reflective surfaces. Variations in the size and shape of the sound ducts 1959, 1960, as noted above, may be made while still achieving superior or at least acceptable sound output quality. An example of another speaker unit 1100 with closely spaced speakers, shown in cutaway top view in FIG. 11, is similar in certain respects to FIG. 19, but the sound damping material 1119 is tapered towards the front of the speaker mounting structure 1104, thereby forming sound ducts 1106, 1116 associated with each of the two speakers 1107, 1117 which gradually widen towards the front of the speaker mounting structure 1104. Other variations in the shaping of the sound damping material 1119 are possible as well.

Like the central partition 1216 (FIGS. 12A-2C) or 1216' (FIG. 23A), the central strip or section 1913 of the sound-damping material 1912 shown in FIG. 19 (or the analogous portion of the sound damping material 1119 shown in FIG. 11) may help prevent interference between the acoustic output of the left and right speakers 1914, 1915, provided that the sound-damping material 1912 in the central strip or section 1913 is dense enough to effectively isolate the sound ducts 1959, 1960 from one another. The central strip of section 1913 of the sound-damping material 1912 may further provide the advantage of eliminating or lessening the severity of standing waves that could, in certain embodiments, develop due to the particular shape or nature of the sound ducts 1919, 1920, and the presence of a more sound-reflective central partition. The sound-damping material 1912 preferably has sufficient acoustic absorption so as to reduce or eliminate the possible buildup of standing waves. By eliminating a more reflective central partition (such as 1216 in FIGS. 12A-12C or 1216' in FIG. 23B) and replacing it with a central strip or section 1913 of sound-damping material 1912, the effective width of the central strip or section 1913 can be effectively doubled (as compared to simply adding sound-damping material to either side of the central partition 1216 or 1216'), thus potentially improving its ability to counteract the buildup of standing waves. Moreover, the sound-damping material 1912 in its entirety preferably helps minimize the variation of sound output response with respect to frequency so that the output of speakers 1914, 1915 can be readily equalized by, e.g., any standard techniques, including analog or digital equalization. For example, cascaded filter sections may be employed to tailor the frequency response of the speakers 1914, 1915 in discrete frequency bands so as to provide a relatively uniform overall frequency response.

Figure 23B:
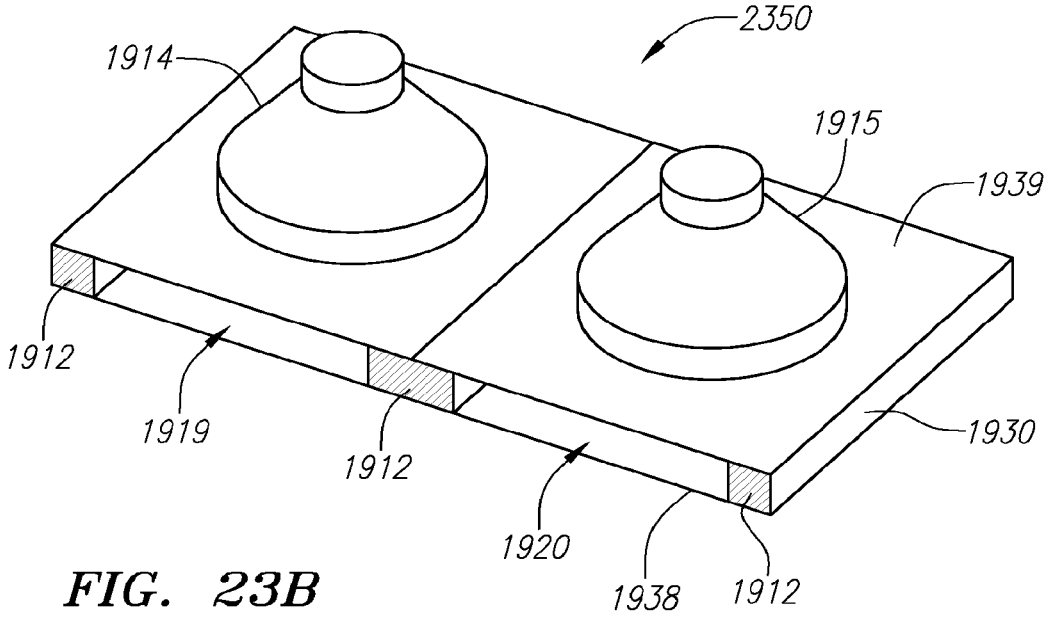

FIG. 23B illustrates one particular embodiment of a speaker mounting structure in accordance with certain principles described with respect to FIGS. 19A and 19B. As illustrated in FIG. 23B, speakers 1914, 1915 may be disposed on a baffle comprising speaker mounting plate 1939 (which is a top plate in this example). A sound reflecting plate 1938 (the bottom plate in this example) is positioned in a generally parallel orientation with respect to the speaker mounting plate 1939, and is separated therefrom by a layer of sound-damping material 1912 such as compressed foam. Rigid side panels 1930, or alternatively struts or other rigid members along the sidewall regions and/or, if desired, within the sound-damping material 1912, may optionally be provided for mechanical support. The front of speaker mounting structure illustrated in FIG. 23B may be compared against that shown in FIG. 23A, which does not show sound-damping material extending substantially to the front of output slots 1219*a*, 1219*b*.

A speaker system in accordance with principles and concepts as disclosed herein may include more than two speakers. Various embodiments, for example, utilize multiple speakers in each of the left and right channels, with the multiple speakers in each channel outputting sound through a common sound duct or channel and out an orifice (such as an aperture or slot). Examples of such embodiments are illustrated in FIGS. 17A-17C, 20, and 22. In the embodiment shown in FIGS. 17A and 17B, multiple (two in this example) speakers 1714*a*, 1714*b* are disposed in series along a sound duct 1759 on one side of the speaker mounting structure 1701, and, likewise, multiple (two in this example) speakers 1715*a*, 1715*b* are disposed in series along a sound duct 1760 on the other side of the speaker mounting structure 1701. In effect, each of the left and right audio channels has multiple speakers, which may provide advantages such as, for example, increased output capacity, different frequency ranges for different speakers, or other advantages. Similar to the embodiment illustrated in FIG. 19, sound-damping material 1712 such as compressed foam surrounds the rear contours of the speakers 1714*a* and 1715*a* furthest from the output slots 1719, 1720, and extends to the front 1732 of the speaker mounting structure 1701 so as to form left and right sound ducts 1759, 1760. The sound ducts 1759, 1760 are preferably (but not necessarily) of substantially uniform width, generally matching the width of speakers 1714*a*, 1714*b* and 1715*a*, 1715*b*. The speakers 1714*a*, 1714*b*, 1715*a*, 1715*b* may be of identical size and audio characteristics, or else, in alternative embodiments, may be of different sizes, shapes, and/or audio characteristics.

Figure 17A:
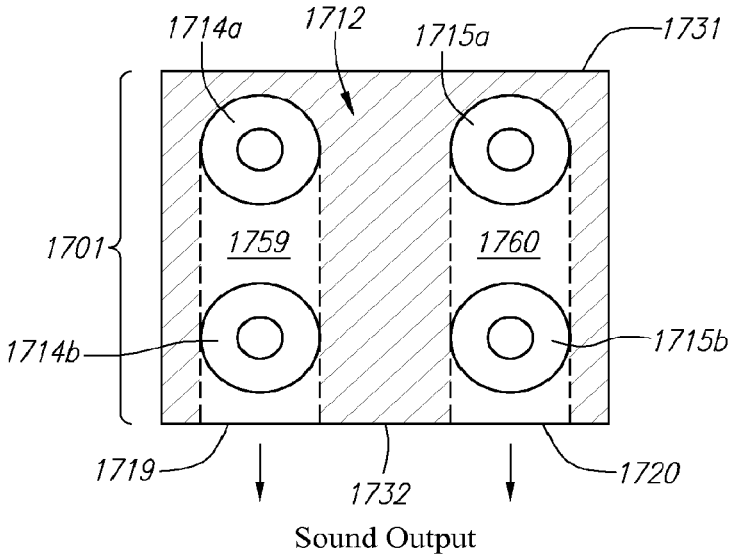
FIGS. 17A and 17B are diagrams of a speaker arrangement as may be used, for example, in connection with a speaker mounting structure or enclosure for providing sound output through an orifice.
Figure 17B:
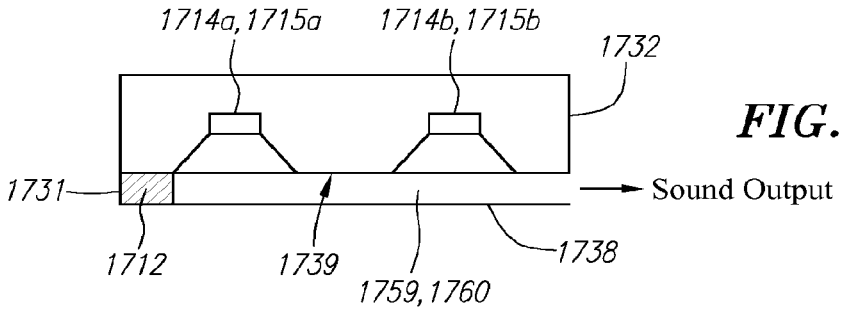

FIG. 17B illustrates a cutaway side view of the speaker mounting structure 1701 shown in FIG. 17A, with speakers 1714*a* (or 1715*a*) and 1714*b* (or 1715*b*) shown in side profile. The speakers 1714*a*, 1714*b*, 1715*a*, 1715*b* are mounted upon a baffle comprising a speaker mounting surface 1739. The speaker mounting surface 1739 and a sound reflecting surface 1738, which are preferably rigid and substantially non-resonant in nature, define sound ducts 1759, 1760 and allow propagation of the acoustic output of speakers 1714*a*, 1714*b*, 1715*a*, 1715*b* through output slots 1719, 1720. The shape of the sound-damping material 1712, generally in this example following the rear contours of the furthest speakers 1714*a*, 1715*a* from the output slots 1719, 1720, tends to improve the quality of the output sound by preventing expansion of the sound waves in a rearward direction, and thereby reducing potential interference or other undesirable acoustic effects. While FIG. 17B shows an enclosure surrounding speakers 1714*a*, 1714*b*, 1715*a*, 1715*b*, such an enclosure is not necessary and can be omitted.

In some situations, depending in part upon the size and shape of the sound ducts 1759, 1760 and the nature of the audio material, it may be possible for standing waves to develop within the sound ducts 1759, 1760 which adversely impact the quality of the audio output. The particular dimensions of the sound ducts 1759, 1760 and length, width, and/or thickness of the sound-damping material 1712 can be optimized by experimentation in order to yield the optimal sound quality for a given type of speakers 1714*a*, 1714*b*, 1715*a*, 1715*b*, a given audio track or type of audio material, compositions or materials used to form the speaker mounting structure (such as those used to form the rigid interior surfaces and/or the sound-damping material), and so on, by eliminating cross-modes and lengthwise modes associated with standing waves in the sound ducts 1759, 1760.

Figure 17C:
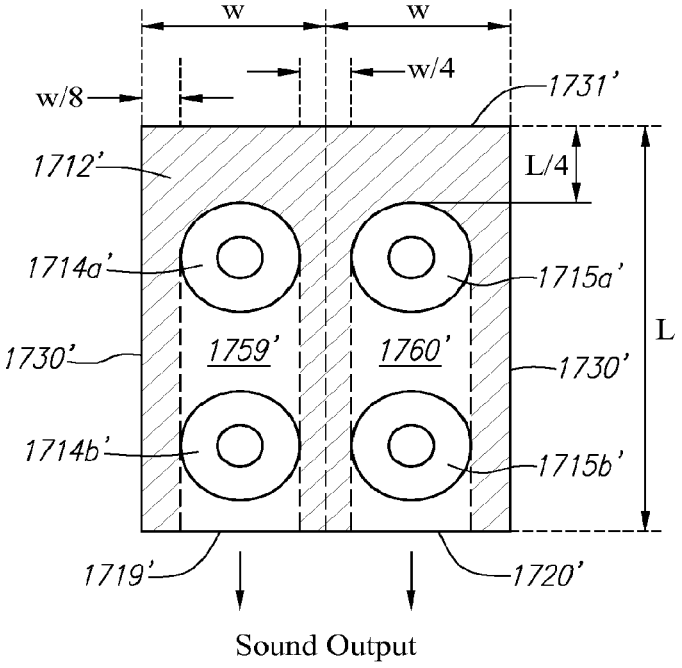
FIG. 17C is a particular variation thereof illustrating preferred dimensions of sound-damping material according to one example.

FIG. 17C illustrates an example of preferred dimensions for the sound-damping material 1712' where four speakers 1714*a*', 1714*b*', 1715*a*', and 1715*b*' are used in speaker assembly of the type generally illustrated in FIG. 17A. As shown in FIG. 17C, the amount of sound-damping material 1712' that is placed to either side of a sound duct 1759' or 1760' may be approximately W/8, where W represents the outer width boundaries of the sound-damping material 1712' for a given channel. With two channels, the sound-damping material 1712' may be combined in the center portion between the two sound ducts 1759', 1760', yielding a collective width of approximately W/4, as illustrated in FIG. 17C. Similarly, the amount of sound-damping material 1712' that is placed at the rear of each sound duct 1759', 1760' may be approximately L/5 to L/4, where L represents the outer length boundaries of the sound-damping material 1712' for a given channel (assuming the sound-damping material 1712' extends to the edge of slots 1719', 1720').

The particular dimensions illustrated in FIG. 17C are simply representative of one example. In practice, it may be expected that good results with respect to sound quality may be obtained over ranges of different widths of sound-damping material 1712' placed to either side of a sound duct 1759' or 1760' and to the rear of the further speakers 1714*a*', 1714*b*' from the slots 1719', 1720'. Moreover, similar parameters may be applied, as appropriate, to embodiments having a single row of speakers such as the one shown in, e.g., FIG. 19A.

Returning to FIGS. 17A and 17B, the thickness of the sound-damping material 1712 is preferably sufficient to fill the volume (except for the sound ducts) between the surface mounting plate 1739 and sound reflecting plate 1738 without gaps that might cause cross-mode interference or the creation of sound artifacts, and thus may generally be dictated by the distance of separation of the surface mounting plate 1739 and the sound reflecting plate 1738. Typically, the thickness of the sound-damping material 1712 might be in the range of, e.g., ½" to 1" thick, although the thickness may vary depending upon the size and shape of the relevant portions of the speaker mounting structure 1701.

While the size and shape of the sound ducts 1759, 1760 and output slots 1719, 1720 may vary depending upon the particular design preferences for the vehicle sound system, there may be physical or practical limitations to how narrow the sound ducts 1759, 1760 or output slots 1719, 1720 may be made. Narrowing of the sound ducts 1759, 1760 or output slots 1719, 1720 may decrease the efficiency of the speakers (which may be compensated by larger speakers and/or increased drive power), and may cause audible noise from turbulence. Therefore, the narrowness of the sound duct or slot size may be limited by, among other things, impedance losses that cannot be made up by increased drive power and the onset of sound artifacts or noise caused by turbulence or nonlinear airflow.

While the embodiment illustrated in FIGS. 17A-17C shows two speakers in series for each channel, the same principles may be extended to any number of speakers in series in each speaker channel.

Figure 20:
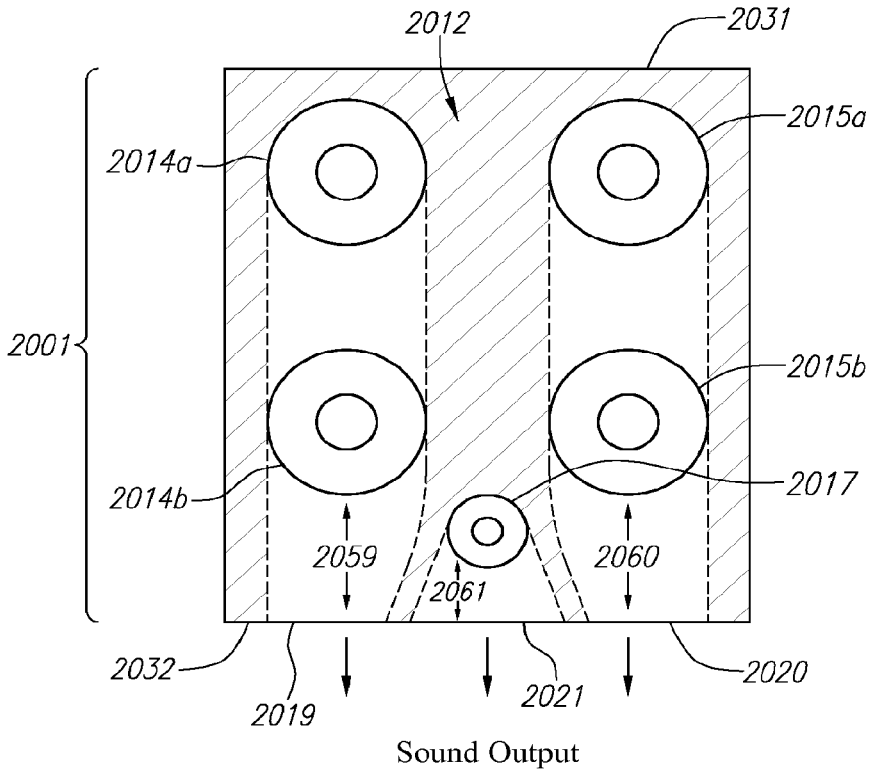
FIG. 20 is a cutaway top-view diagram of another speaker arrangement similar to FIG. 17A but adding an additional speaker.

FIG. 20 is a cutaway top-view diagram of another speaker arrangement similar to FIG. 17A but adding an additional speaker. The layout of the speaker mounting structure 2001 shown in FIG. 20 is similar to that of FIG. 17A, with "rear" speakers 2014*a*, 2015*a* and "front" speakers 2014*b*, 2015*b* placed over left and right sound ducts 2059 and 2060 as illustrated. An additional speaker 2017, such as, e.g., a domed tweeter, is added between the left and right sound ducts 2059, 2060, and the sound-damping material 2012 (e.g., compressed or expanded foam) is preferably formed so as to define a central sound duct 2061, which in this example is relatively short. In the case where the additional speaker 2017 is a tweeter or else handles significant high frequency signal components, it is generally desirable to place the speaker 2017 as near to the output slot 2021 as possible. The additional speaker 2017 may have a relatively narrow output slot 2021, for example, 6-8 millimeters in height. Where available space is a concern, or where it is desired to achieve certain specific dimensions of sound-damping material surrounding the left and right sound ducts 2059, 2060, the sound ducts 2059, 2060 may be tapered slightly towards the sound output slots 2019, 2020 in order to accommodate the central sound duct 2061. In alternative embodiments, the sound ducts 2059, 2060 may not be tapered. The central sound duct 2061 may flare outwards as it extends towards the central output slot 2021 so as to provide a relatively broad directional characteristic.

One potential advantage of using speaker output slots 2019, 2020, and 2021 (and similar configurations in other embodiments disclosed herein), is that the effective radiation sources of the speakers can be brought closer together, leading to a cleaner, smoother sound image both on and off axis, and reducing the potential for destructive interference or other undesirable sound distortion due to perceptible time delays between the left and right acoustic output. Moreover, in certain embodiments, the perceptible sound output may be stable and not fall off at relevant frequencies regardless of the listener's relative position along the narrower axis of the slot(s) 2019, 2020 and 2021 (or at least not until approximately 90 degrees off angle), such that the speaker system provides uniform and wide coverage of substantially all the listening area in a near omnidirectional manner.

Figure 21:
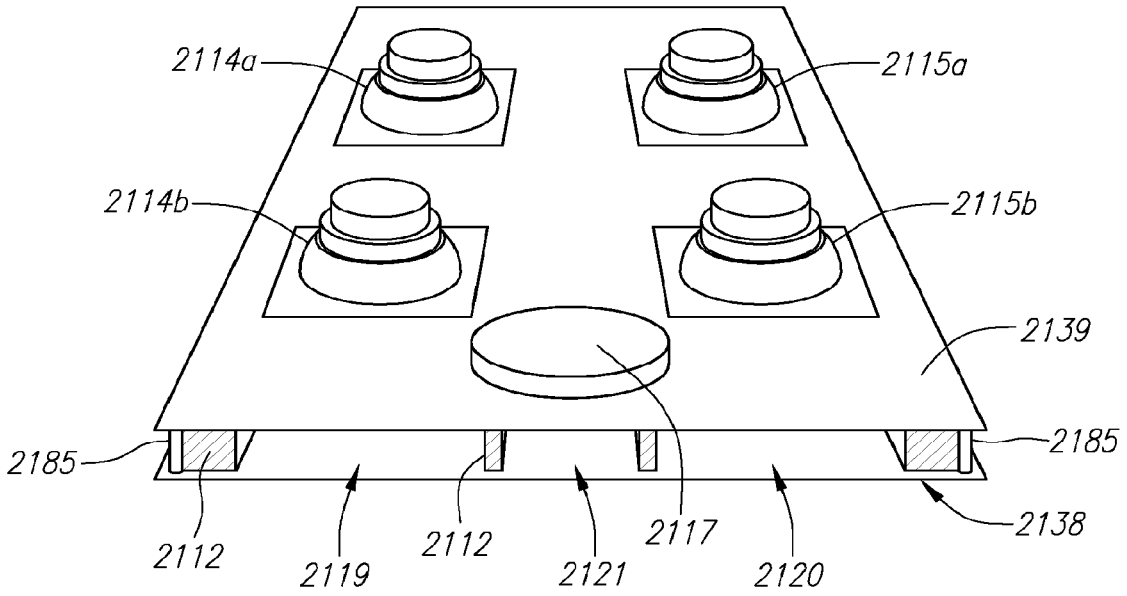
FIG. 21 is an oblique view diagram of the speaker arrangement of FIG. 20, illustrating one possible embodiment of a speaker mounting structure associated therewith.

FIG. 21 is an oblique view diagram in general accordance with the speaker arrangement of FIG. 20, illustrating one possible embodiment of a speaker mounting structure associated therewith. As shown in FIG. 21, a baffle comprising a speaker mounting plate 2139 may define several openings for placement of various the speakers 2114*a*, 2114*b*, 2115*a*, 2115*b* (and optionally 2117). The speaker mounting plate 2139 may be physically attached to a sound reflecting plate 2138 by multiple struts 2185 placed at, e.g., the corners and/or along the sides of each of the speaker mounting plate 2139 and the sound reflecting plate 2138. Advantageously, a compressable sound-damping material 2112, such as foam, may be placed between the speaker mounting plate 2139 and the sound reflecting plate 2138 and compressed therebetween. To facilitate compression of the sound-damping material 2112, the struts 2185 may take the form of threaded bolts which may be screwed into threaded holes (not shown) aligned in the speaker mounting plate 2139 and sound reflecting plate 2138. Tightening the threaded bolts has the effect of compressing the sound-damping material 2112. As previously described, the sound-damping material 2112 may be used to form sound ducts for the speakers 2114*a*, 2114*b*, 2115*a*, 2115*b*, 2117 which terminate in sound output slots 2119, 2120, and 2121 as shown. A similar technique for constructing a speaker mounting structure may be applied to the various other embodiments described herein, including for example, those illustrated in FIGS. 12A-12B and 17A-17C, or others.

Figure 22:
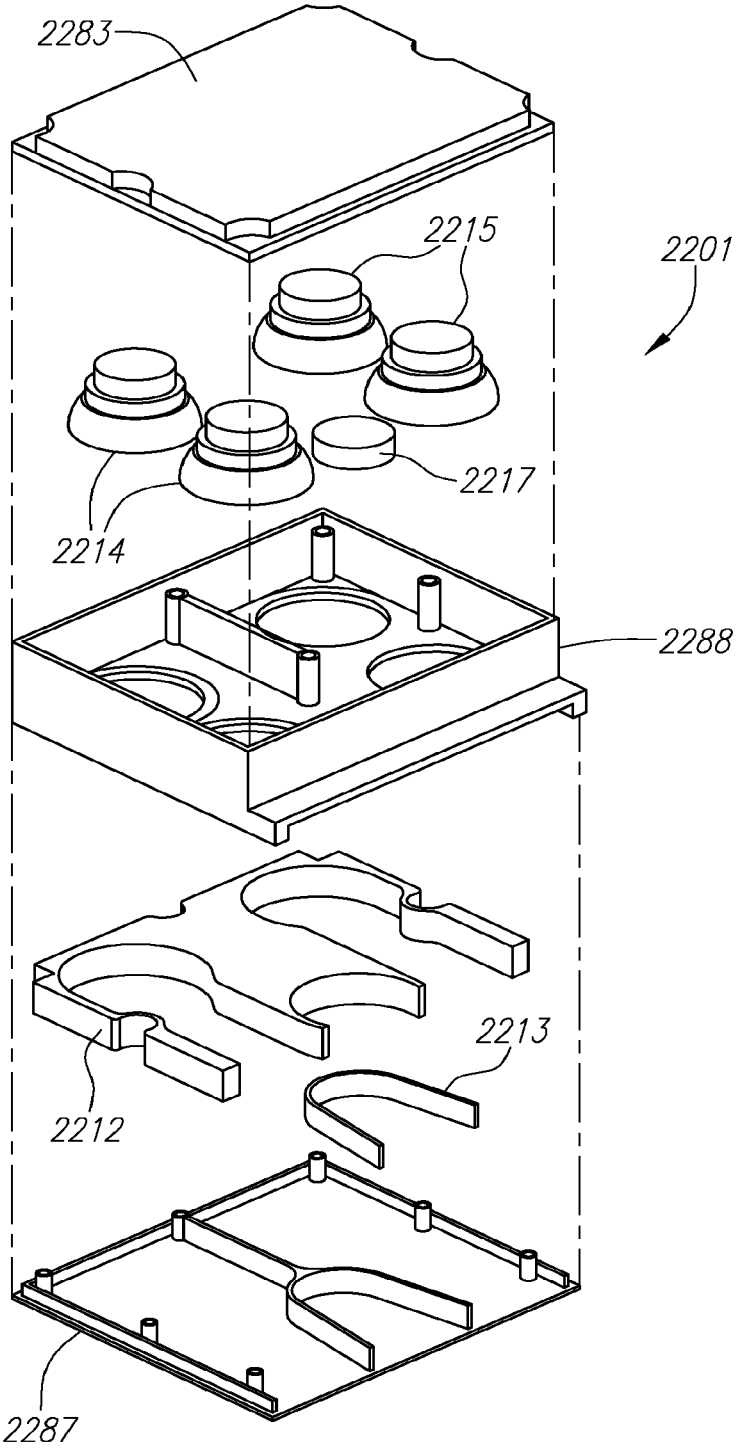
FIG. 22 is an assembly diagram of a speaker mounting structure utilizing a general speaker arrangement such as shown in FIG. 20.

FIG. 22 is an assembly diagram of a speaker unit 2201 utilizing a general speaker arrangement such as shown in FIG. 20. As illustrated in FIG. 22, the speaker unit 2201 includes a baffle comprising a speaker mounting structure 2288 which has several openings for placement of speakers 2214, 2215 (and optionally 2217). In this particular example, the speaker mounting structure 2288 has a speaker mounting plate around the periphery of which are walls surrounding the speakers 2214, 2215, 2217, but such walls may not be necessary or desired in other embodiments. A sound reflecting plate 2287 is configured to generally match the bottom dimensions of the speaker mounting structure 2288. Sound-damping material 2212, 2213 may be preformed in one or more pieces to define sound ducts for the various speakers 2214, 2215, 2217, and is preferably compressed or expanded between sound reflecting plate 2287 and the speaker mounting enclosure 2288. In this particular example, a speaker enclosure ceiling 2283 is adapted for placement atop the speaker mounting structure 2288, thereby forming a speaker enclosure. The speaker enclosure ceiling 2283 may have multiple holes through which, e.g., threaded bolts may be inserted for ultimate securing to the sound reflecting plate 2287, which may have threaded holes in matching alignment with the holes in the speaker enclosure ceiling 2283. As previously described, tightening of the threaded bolts may advantageously provide compression of the sound-damping material 2212, 2213.

Figure 24:
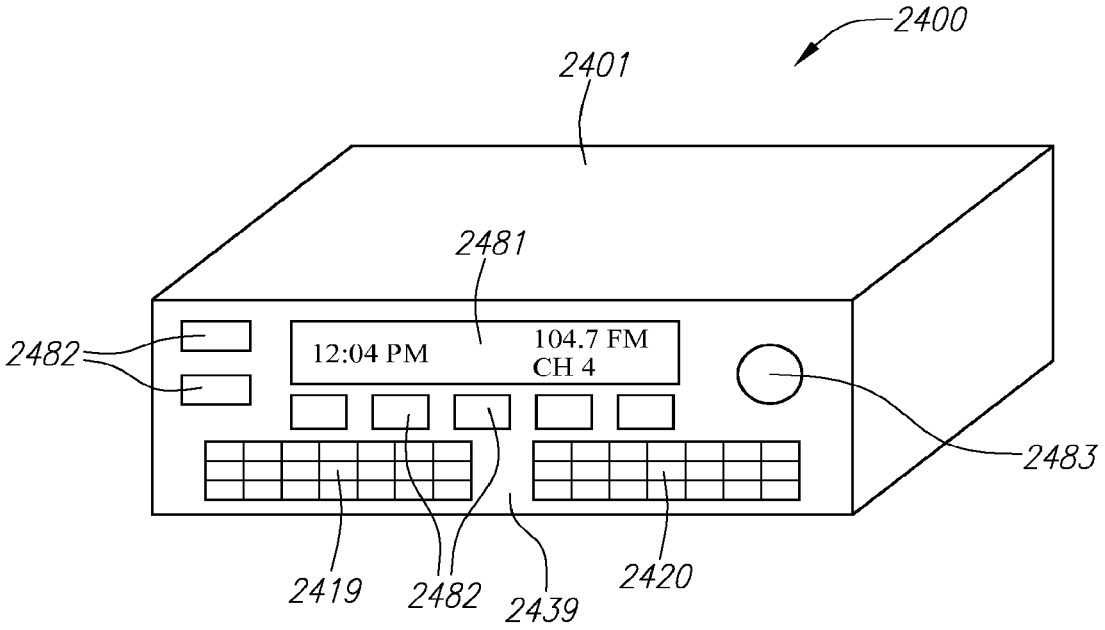
FIG. 24 is a diagram showing an example of a stereo unit 2400 adapted for convenient installation in a vehicle.

With the speaker unit 2201 of FIG. 22, or with other embodiments described herein, it may be desirable to package one or more speakers, sound processing electronics or components for the speakers, and, if desired, other electronics (such as a receiver, amplifiers, onboard computer, etc.) in a single discrete unit that may be conveniently installed in a vehicle as, e.g., a substitute for a vehicle's existing in-dash stereo unit. FIG. 24 is a diagram showing an example of a stereo unit 2400 adapted for convenient installation in a vehicle. In the example of FIG. 24, the stereo unit 2400 includes an enclosure 2401 housing two or more internal speakers (not shown) which radiate sound via output slots 2419 and 2420 (illustrated with speaker grills which may be added for aesthetic purposes). Internally, the stereo unit 2400 may contain, e.g., two speakers with foam-surrounded sound ducts similar to the arrangement illustrated in FIGS. 19A and/or 23B. On any available space of a front panel 2439 of the stereo unit 2400 may be placed a display 2481 and various controls, buttons and/or knobs 2482 and 2483 which may be found on conventional in-dash stereo units. In addition to the speakers, the stereo unit 2400 may contain electronics such as a receiver, amplifier(s), equalizers, sound processing components, etc., to provide the functionality of an in-dash stereo unit. The enclosure 2401 of the stereo unit may be of appropriate dimension to fit within a standard (single or double) DIN slot or other similar or analogous space, to allow convenient substitution of a vehicle's existing stereo unit. The stereo unit 2400 may also have various electrical connections or ports (not shown) to allow electrical connection to external speakers or other electronic components in the vehicle.

Additional details relating to closely spaced speaker configurations and sound processing relating thereto may be found in, e.g., U.S. application Ser. Nos. 10/339,357 and 10/074,604, and PCT Application Ser. No. PCT/US02/03880, each of which is assigned to the assignee of the present invention, and all of which are incorporated herein by reference as if set forth fully herein.

It should be emphasized that, while various embodiments have been illustrated in the drawings with the speakers positioned or mounted on the apparent "top" of the speaker mounting assembly or speaker enclosure, the speaker mounting assembly may be placed in any desired orientation. Thus, where terms such as "top" and "bottom" or "left" and "right" are used herein, they are not meant to convey absolute orientation but rather relative orientation with respect to a reference frame that may be rotated or otherwise manipulated. The speaker mounting assembly may be placed in any suitable orientation such that, for example, the sound output slots are vertical rather than horizontal, or the speaker mounting surface is below the sound reflecting surface.

Where speakers are placed in series such as shown, for example, in the embodiments illustrated in FIGS. 17A-17C, 20, and 21, interference between the speakers may potentially occur due to the fact that the "front" speakers (e.g., 1714*b*, 1715*b*) are closer to their respective output slots (e.g., 1719, 1720) than the "rear" speakers (e.g., 1714*a*, 1715*a*). As a result, sound from the rear speakers takes longer to propagate down the sound duct and emanate out of the output slot than with the front speakers. Because the acoustic output from the front and rear speakers are delayed relative to one another, the sound waves can interfere and lead to destructive cancellation of as much as 10 dB or possibly more, or can lead to other anomalies. In order to prevent the "delayed" output from the rear speakers causing destructive interference with the output from the front speakers or other undesirable effects, it may be desirable to add a delay to the drive signal feeding the front speakers, such that the sound output is synchronized relative to the output slot. In addition to delaying the signal to the forward speakers 1714*b*, 1715*b*, the power level for the rearward speakers 1714*a*, 1715*a* may be increased.

Figure 18:
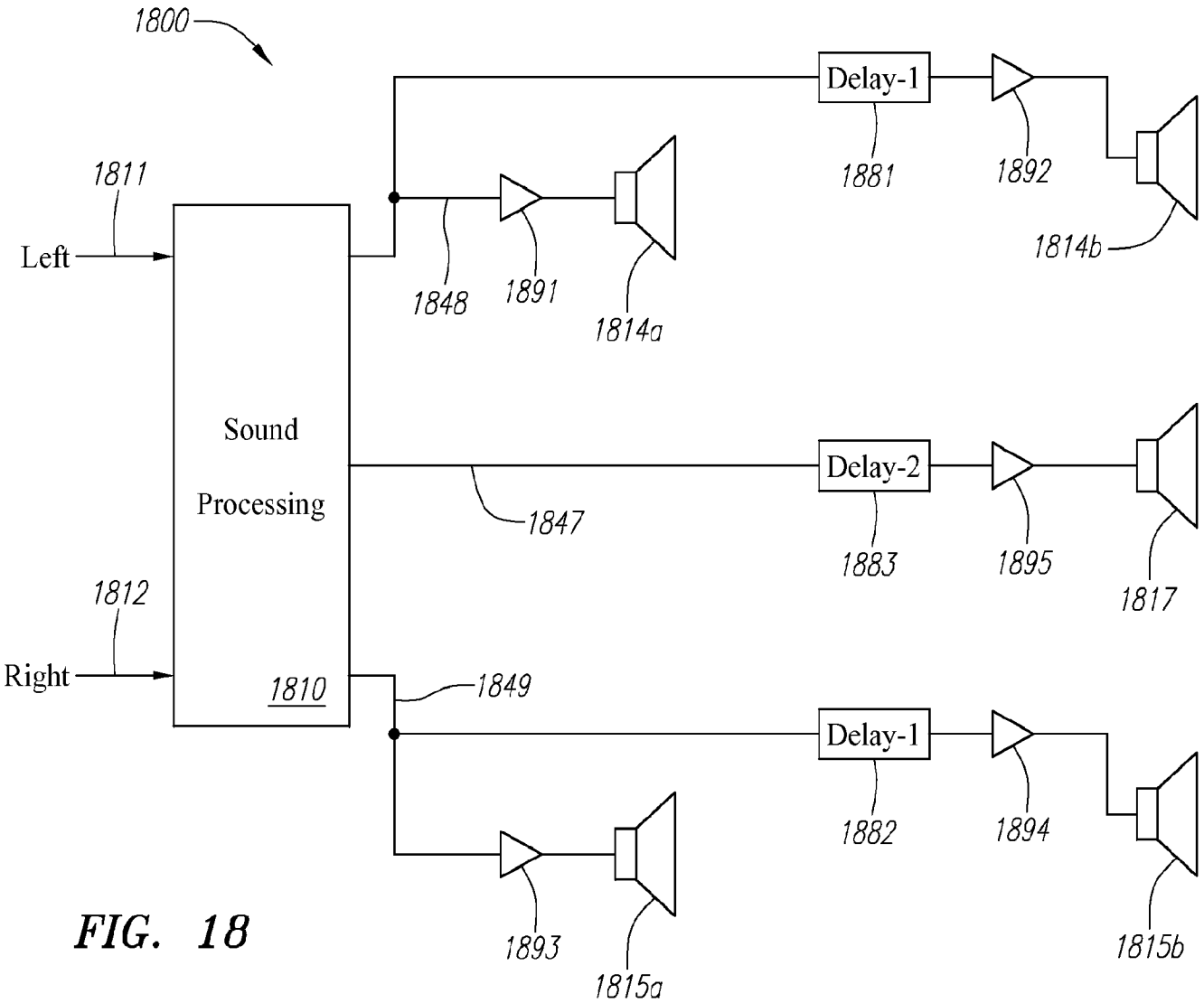
FIG. 18 is a simplified circuit diagram for the speaker arrangement of FIGS. 17A and 17B, wherein delays are used to synchronize sound output through the orifice.

FIG. 18 is a simplified diagram of a circuit 1800 that may be used in, e.g., the speaker arrangements of FIGS. 17A-17C or FIG. 20, wherein delays are used to synchronize sound output between the front and rear speakers relative to the output slots. As shown in FIG. 18, left and right channel audio signals 1811, 1812 are fed into a sound processor 1810, as described elsewhere with respect to, e.g., FIG. 14 or 29, and modified left and right channel audio signals 1848, 1849 are generated. The left channel audio signal 1848 is applied to the "rear" left speaker 1814*a* (via driver 1891) and, though a delay 1881, to the "front" left speaker 1814*b* (via driver 1892). Similarly, the right channel audio signal 1849 is applied to the "rear" right speaker 1815*a* (via driver 1893) and, through a delay 182, to the "front" right speaker 1815*b* (via driver 1984). If a tweeter 1817 (or other additional speaker) is provided, then the appropriate audio signal 1847 may be provided to the tweeter 1817 through a delay 1883 and driver 1895. The delays 1881, 1882, and 1883 may be derived from the distance between each front speaker 1814*b*, 1815*b* and its respective rear speaker 1814*a*, 1815*a*, given the known velocity of sound travel. For example, assuming the left and right channels are symmetrical in layout, the delays 1881, 1882 are preferably based upon the center-to-center distance of the rear speaker 1814*a*, 1815*a* to the front speaker 1814*b*, 1815*b*, divided by the velocity of sound. (about 1116 feet per second). Analogously, the delay 1883 for the tweeter 1817 is preferably based upon the center-to-center distance of the tweeter 1817 to the front speakers 1814*b*, 1815*b* along the lengthwise axis of the sound ducts. The delays 1881, 1882, 1883 may take the form of any suitable electronic circuitry (either active or passive), and preferably have no impact on the content of the audio signals 1847, 1848, 1849, at least over the frequencies being audially reproduced by the speakers.

While the example illustrated in FIG. 18 shows a particular system configuration, it will be appreciated that other variations may be made as well drawing upon similar principles. For example, rather than having five drivers 1891-1895, one for each speaker 1814*a*, 1814*b*, 1815*a*, 1815*b*, and 1817, fewer drivers (e.g., three) or more may be used, with, for example, a single driver being shared by two speakers (e.g., 1814*a* and 1814*b*).

In one aspect, an automotive sound system is provided which encompasses a combination of speaker configuration, speaker placement, and sound processing to reduce or minimize the undesired sonic effects of the inevitable asymmetries between the listeners and speaker positions in a car or similar vehicle, and to provide more uniform sound for all the occupants. A pair of speakers, or two (or more) rows of speakers, are preferably placed close together and located in the front of the console or dashboard with their geometric center on, or as near as possible to, the central axis of symmetry of the vehicle. A sound processor acts to "spread" the sound image produced by the two closely spaced speakers by employing a cross-cancellation technique in which the cancellation signal is preferably derived from the difference between the left and right channels. The resulting difference signal is scaled, delayed (if necessary), and spectrally modified before being added to the left channel and, in opposite polarity, to the right channel. The pair of speakers may be placed on a common mounting surface, and/or in a common housing enclosure having a slot for allowing sound to emanate. Additional bass speakers may be added (in the doors, for example) to enhance bass sound reproduction.

In various embodiments as described herein, improved sound quality results from creation of a sound image that has stability over a larger area than would otherwise be experienced with, e.g., speakers spaced far apart without comparable sound processing. Consequently, the audio product can be enjoyed with optimal or improved sound over a larger area, and by more listeners who are able to experience improved sound quality even when positioned elsewhere than the center of the speaker arrangement. Thus, for example, an automobile or vehicular sound system may be capable of providing quality sound to a greater number of listeners, not all of whom need to be positioned in the center of the speaker arrangement in order to enjoy the rendition of the particular audio product.

It will be appreciated that a drive unit or speaker system having sound radiated through a slot or aperture can be useful with a single channel or speaker, as well as with multiple channels or speakers, even apart from the use of signal processing to, e.g., modify or improve the sound output of two closely spaced centrally located speakers. For example, one or more speakers may be located in a central slotted speaker enclosure or arrangement with or without added signal processing to produce a widened sound image or similar effects. Similarly, one or more speakers may be located in a slotted speaker enclosure or arrangement on the left and/or right sides of the vehicle, or in other locations (along the central axis or otherwise), in order to provide speaker outputs having a minimized output profile or minimized radiating surface area. A drive unit or speaker configured in such a manner may have improved visual appearance, take up less surface area, and/or provide an improved directional characteristic (which can be particularly important if the speaker is located at other than ear level).

Figure 25:
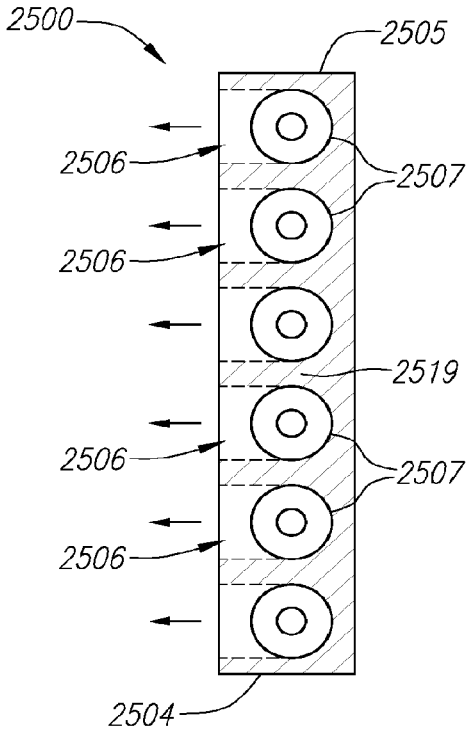
FIG. 25 is a top-view cross-sectional diagram of a speaker arrangement including an array of speakers with sound output slot(s), in accordance with one embodiment as disclosed herein.

Another embodiment of a speaker system is illustrated in FIG. 25, which illustrates a top-view cross-sectional view of an array of speakers 2507 each having individual sound output slots 2506. The speaker system 2500 of FIG. 25, in one aspect, expands upon the basic arrangement depicted in FIG. 19A, by offering an arbitrary number of speakers 2507 arranged in a linear array. The speakers are separated by sound damping material 2519 which, in the manner described with respect to FIG. 19A and other similar embodiments herein, defines sound output slot(s) 2506 for directing the radiation of sound output by the speakers 2507. The speakers 2507 may be mounted to a baffle or other mounting surface as previously described herein.

Figure 26A:
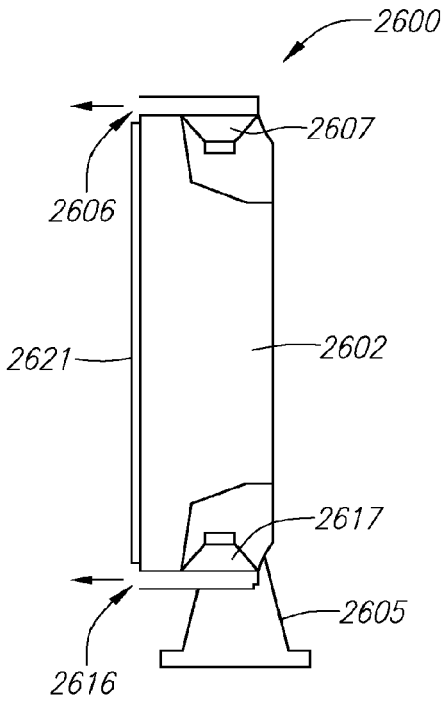
FIGS. 26A and 26B are cross-sectional diagrams of a side view and a front view, respectively, of a flatscreen display device having speaker arrays with sound output slot(s).
Figure 26B:
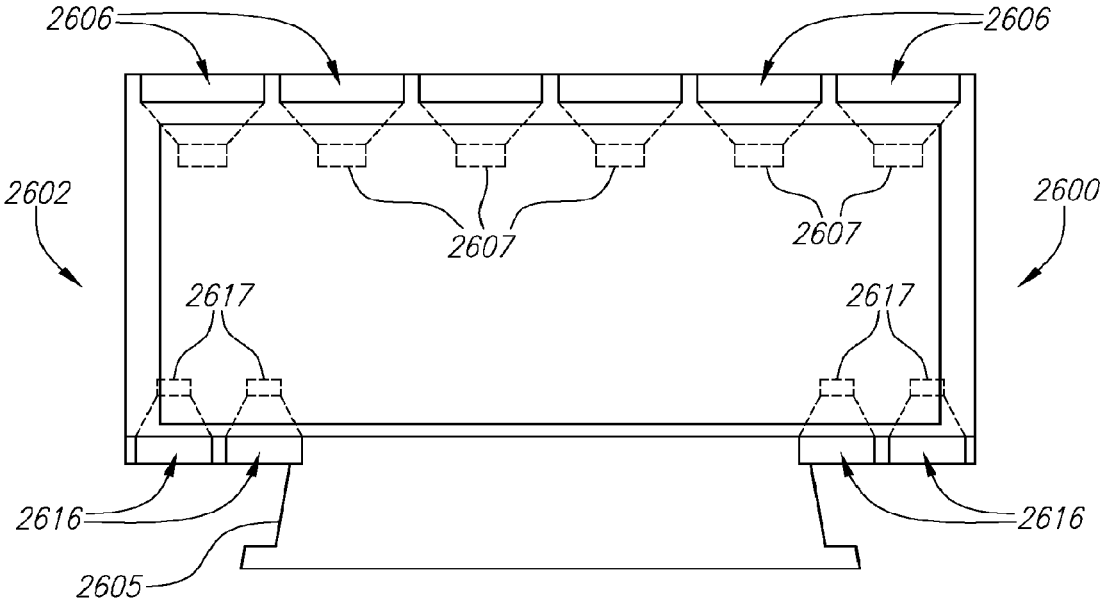

FIGS. 26A and 26B illustrate a potential application of the speaker array illustrated in FIG. 25. FIG. 26A shows a cross-sectional side view of a flatscreen display device 2600 (such as a flatscreen or plasma television, or a computer monitor), while FIG. 26B shows a front view thereof. The display device 2600 has a housing 2602 with a screen 2621, which are collectively mounted on a stand 2605. A speaker array comprised of speakers 2607 are arranged linearly along the top-side of the display device housing 2602, facing upwards, with their respective output slots 2606 forming an elongate output slot. Similarly, smaller speaker arrays comprised of speakers 2617 are arranged linearly along the bottom side of the display device housing 2602, facing downwards, with their respective output slots 2616 forming elongate output slots on either side of the stand 2605. The illustrated speaker arrangement requires significantly less surface area than a conventional arrangement of forward-facing speakers, and the cones of the speakers 2607, 2617 may be advantageously concealed behind the body of the housing 202, as illustrated, thus keeping the depth of the display device 2600 minimal. The output slots 2606, 2616 may be covered with, e.g., a grille or perforated mesh to conceal their presence. Sound processing may optionally be added to the signals provided to speakers 2607, 2617 in the various speaker arrays, to account for the different speaker positions. Of course, the number of speakers 2607, 2617 and the relative positions of the speaker arrays may be varied according to the needs of a particular design. For example, the speaker arrays could be located along the left and right sides of the display device housing 1602. Moreover, the speakers 2607 and/or 2617 could be arranged as speaker pairs, similar to the inline speaker unit depicted in FIG. 15, at the expense of perhaps increased height or vertical dimension of the display device housing 2602. However, such an arrangement could potentially double the number of speakers available for use.

Figure 27:
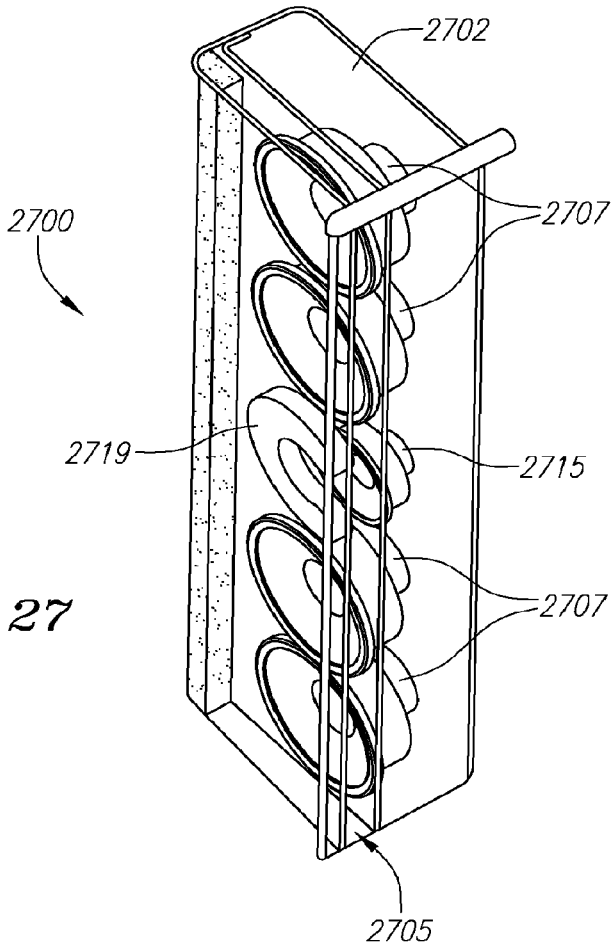
FIG. 27 is an oblique view diagram of a speaker unit having an array of speakers and sound output slot(s).

FIG. 27 illustrates another embodiment, in an oblique view, of a speaker unit 2700 having an array of speakers 2707 and sound output slot(s). In FIG. 27, speakers 2707 form a linear array as generally described with respect to FIG. 25, with the addition of a high frequency speaker (e.g., tweeter) 2715 which is centrally located in the speaker array. A contoured region of sound damping material 2719 (compressed foam or other suitable material) surrounds the periphery of the tweeter 2715, and may also be used (although not shown) to surround the other speakers 2707 in a similar manner, such as previously described with respect to FIG. 25. An elongate output slot 2705 radiates the sound from the various speakers 2707, 2715, according to similar principles as previously described herein with respect to a number of other embodiments.

In any of the foregoing embodiments, the audio product from which the various audio source signals are derived, before distribution to the various automobile speakers or other system components as described herein, may comprise any audio work of any nature, such as, for example, a musical piece, a soundtrack to an audio-visual work (such as a DVD or other digitally recorded medium), or any other source or content having an audio component. The audio product may be read from a recorded medium, such as, e.g., a cassette, compact disc, CD-ROM, or DVD, or else may be received wirelessly, in any available format, from a broadcast or point-to-point transmission. The audio product preferably has at least left channel and right channel information (whether or not encoded), but may also include additional channels and may, for example, be encoded in a surround sound or other multi-channel format, such as Dolby-AC3, DTS, DVD-Audio, etc. The audio product may also comprise digital files stored, temporarily or permanently, in any format used for audio playback, such as, for example, an MP3 format or a digital multi-media format.

The various embodiments described herein can be implemented using either digital or analog techniques, or any combination thereof. The term "circuit" as used herein is meant broadly to encompass analog components, discrete digital components, microprocessor-based or digital signal processing (DSP), or any combination thereof. The invention is not to be limited by the particular manner in which the operations of the various sound processing embodiments are carried out.

While examples have been provided herein of certain preferred or exemplary sound processing characteristics, it will be understood that the particular characteristics of any of the system components may vary depending on the particular implementation, speaker type, relative speaker spacing, environmental conditions, and other such factors. Therefore, any specific characteristics provided herein are meant to be illustrative and not limiting. Moreover, certain components, such as the sound processor described herein with respect to various embodiments, may be programmable so as to allow tailoring to suit individual sound taste.

While certain system components are described as being "connected" to one another, it should be understood that such language encompasses any type of communication or transference of data, whether or not the components are actually physically connected to one another, or else whether intervening elements are present. It will be understood that various additional circuit or system components may be added without departing from teachings provided herein.

In any of the embodiments described herein, the speakers utilized in the sound system may be passive or active in nature (i.e., with built-in or on-board amplification capability). The various audio channels may be individually amplified, level-shifted, boosted, or otherwise conditioned appropriately for each individual speaker or pair of speakers.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. A narrow profile sound system, comprising:

a speaker enclosure having a speaker mounting surface and an enclosed chamber;

a drive unit having a front face for generating forward acoustic radiation and being mounted on the speaker mounting surface, such that rearward acoustic radiation from the drive unit is directed into the enclosed chamber;

a sound reflecting plate disposed in front of the drive unit and substantially parallel with the speaker mounting surface, the sound reflecting plate having length and width dimensions generally corresponding to the speaker mounting surface on which the drive unit is mounted, whereby forward acoustic radiation from the drive unit is directed toward the sound reflecting plate; and a narrow sound duct that is no more than 10 millimeters in height and terminates in an elongate output slot, the sound duct being defined at least in part by the sound reflecting plate, the speaker mounting surface, a pair of sidewalls disposed between the sound reflecting plate and the speaker mounting surface, and a curved rear sound duct wall comprising sound damping material and disposed in alignment with and following a curved rear contour of the drive unit such that the rear sound duct wall adjoins the pair of side walls at either end of the rear sound duct wall.

2. The narrow profile sound system of claim 1, wherein the drive unit comprises a cone including said front face for generating forward acoustic radiation, with the cone being substantially contained within the speaker enclosure and the front face of the cone being substantially flush with the speaker mounting surface.

3. The narrow profile sound system of claim 1, wherein a lengthwise dimension of the elongate output slot is greater than a diameter of the drive unit.

4. The narrow profile sound system of claim 3, wherein the sidewalls taper outwards from the respective opposite sides of the drive unit to outer edges of the elongate output slot without any narrowing, at least one of said sidewalls being substantially straight.

5. The narrow profile sound system of claim 1, whereby, due at least in part to the curved rear sound duct wall, forward acoustic radiation from said drive unit reflected by said sound reflecting plate is turned, redirected and channeled through the sound duct towards the elongate output slot.

6. The narrow profile sound system of claim 5, wherein the sound duct is shaped to mitigate accumulation of standing waves.

7. The narrow profile sound system of claim 5, wherein the sidewalls are formed of sound damping material.

8. The narrow profile sound system of claim 1, wherein the sidewalls comprise acoustic foam to dampen acoustic waves.

9. The narrow profile sound system of claim 1, wherein the drive unit is set back from the elongate output slot by a distance greater than a diameter of the drive unit, and wherein the sound duct forms a direct linear path from the drive unit to the elongate output slot without any blockage of the sound duct by either of the sidewalls from the drive unit to the elongate output slot.

10. The narrow profile sound system of claim 1, wherein the sound reflecting plate is comprised of a metallic material.

11. The narrow profile sound system of claim 10, wherein the sound reflecting plate is comprised of aluminum.

12. The narrow profile sound system of claim 1, wherein the sound duct is further defined at least in part by a duct portion extending from a front edge of said enclosed chamber to the elongate output slot.

13. A narrow profile sound system, comprising:

a speaker mounting surface;

a drive unit having mounted on the speaker mounting surface for generating, on opposite sides of the speaker mounting surface, forward acoustic radiation from a concave front face and rearward acoustic radiation from a rear side of the drive unit;

a chamber overlying the speaker mounting surface and substantially containing the drive unit so as to receive rearward acoustic radiation from the drive unit, wherein the speaker mounting surface isolates the forward acoustic radiation and rearward acoustic radiation from the speaker;

a sound reflecting plate disposed in front of the drive unit, parallel with the speaker mounting surface, and positioned to receive the forward acoustic radiation from the drive unit substantially unimpeded; and a sound duct that is no more than 10 millimeters in height and terminates in an elongate output slot, the sound duct being defined at least in part by the sound reflecting plate, the speaker mounting surface, and one or more sidewalls disposed between the sound reflecting plate and the speaker mounting surface;

wherein the sound duct is substantially straight and uniform in width from the drive unit to the elongate output slot.

14. The narrow profile sound system of claim 13, wherein the drive unit is a cone speaker.

15. The narrow profile sound system of claim 13, wherein the drive unit is pistonic.

16. The narrow profile sound system of claim 15, wherein:

the drive unit has a contoured perimeter edge at a rear of the sound duct opposite the elongate output slot;

the one or more sidewalls includes a back wall portion following along the contour of the drive unit's perimeter edge at the rear of the sound duct; and forward acoustic radiation from the drive unit is turned by the sound reflecting surface substantially at a right angle and channeled through the sound duct so that it emanates from the elongate output slot.

17. The narrow profile sound system of claim 16, wherein the sound duct is 6-8 millimeters in height.

18. The narrow profile sound system of claim 13, wherein the sound duct is 6-8 millimeters in height.

19. The narrow profile sound system of claim 13, wherein the one or more sidewalls comprise sound-damping material.

20. The narrow profile sound system of claim 19, wherein the sound-damping material comprises expanded or compressed foam.

21. The narrow profile sound system of claim 19, wherein the sound-damping material comprises rubber, reinforced paper, fabric, fiber or a damped polymer composite.

22. The narrow profile sound system of claim 13, wherein the sound duct is relatively short.

23. The narrow profile sound system of claim 13, wherein a distance from the elongate output slot to a closest point of the drive unit is less than a diameter of the drive unit.

24. A narrow profile sound system, comprising:

a speaker mounting surface;

a drive unit having mounted on the speaker mounting surface;

a chamber overlying the speaker mounting surface and substantially containing the drive unit so as to receive rearward acoustic radiation from the drive unit, wherein the speaker mounting surface isolates the forward acoustic radiation and rearward acoustic radiation from the speaker;

a sound reflecting plate disposed in front of the drive unit, parallel with the speaker mounting surface, and positioned to receive the forward acoustic radiation from the drive unit substantially unimpeded; and a sound duct terminating in an elongate output slot, the sound duct being defined at least in part by the sound reflecting plate, the speaker mounting surface, and one or more sidewalls disposed between the sound reflecting plate and the speaker mounting surface;

wherein the drive unit has a contour at a rear of the sound duct opposite the elongate output slot;

wherein the one or more sidewalls includes a back wall portion following the contour of the drive unit at the rear of the sound duct;

wherein the sound duct does not substantially narrow in width from the drive unit to the elongate output slot and provides a straight path for acoustic travel from the drive unit to the elongate output slot; and wherein forward acoustic radiation from the drive unit is turned by the sound reflecting surface substantially at a right angle and channeled through the sound duct so that it emanates from the elongate output slot.

25. The narrow profile sound system of claim 24, wherein the sound duct, at the location of the drive unit, is approximately the same width as a diameter of the driver unit.

26. The narrow profile sound system of claim 25, wherein the sound duct remains of substantially uniform width from the drive unit to the elongate output slot.

27. The narrow profile sound system of claim 24, wherein the sound duct is no more than 10 millimeters in height.

28. The narrow profile sound system of claim 24, wherein the sound duct is 6-8 millimeters in height.

29. The narrow profile sound system of claim 24, wherein the one or more sidewalls, including the back wall portion, comprise sound-damping material.

30. The narrow profile sound system of claim 29, wherein the sound-damping material comprises expanded or compressed foam.

31. The narrow profile sound system of claim 29, wherein the sound-damping material comprises rubber, reinforced paper, fabric, fiber or a damped polymer composite.

32. The narrow profile sound system of claim 24, wherein the sound duct is relatively short.

33. The narrow profile sound system of claim 24, wherein a distance from the elongate output slot to a closest point of the drive unit is less than a diameter of the drive unit.

34. The narrow profile sound system of claim 24, wherein the one or more sidewalls of the sound duct comprise a left wall and a right wall each extending from the drive unit to respective left and right outer edges of the elongate output slot, wherein the sound duct tapers outwards from the drive unit to the left and right outer edges of the elongate output slot.

35. The narrow profile sound system of claim 34, wherein the sound duct tapers outwards linearly along both the right and left walls of the sound duct.

36. The narrow profile sound system of claim 34, wherein the shape and narrowness of the sound duct suppresses formation of standing waves in the sound duct.

37. The narrow profile sound system of claim 34, wherein the sound reflecting plate, the speaker mounting surface, and one or more sidewalls are arranged to provide the sound duct with a general shape of a rectangular parallelepiped.

* * * * *

UNITED STATES PATENT AND TRADEMARK OFFICE

CERTIFICATE OF CORRECTION

PATENT NO. : 9,363,586 B2
APPLICATION NO. : 13/798006
DATED : June 7, 2016
INVENTOR(S) : Lawrence R. Fincham It is certified that error appears in the above-identified patent and that said Letters Patent is hereby corrected as shown below:

TITLE PAGE

Item 63 the following priority information was omitted from the patent:
Related U.S. Application Data
Continuation of Application Ser. No. 13/208,923 is a continuation of U.S. Application Ser. No. 12/246,433 filed October 6, 2008, now U.S. Patent No. 8,027,500 which is a divisional application of U.S. Application Ser. No. 10/937,796 filed September 8, 2004, now U.S. Patent No. 7,433,488, which is a continuation-in-part application of U.S. Application Ser. No. 10/339,357 filed January 8, 2003, now U.S. Patent No. 7,457,425, which is a continuation-in-part application of utility application U.S. Application Ser. No. 10/074,604 filed on February 11, 2002, now U.S. Patent No. 7,254,239, (which claims the benefit of U.S. Provisional Application Ser. No. 60/267,952, filed on February 9, 2001). Application Ser. No. 10/339,357 further claims the benefit of U.S. Provisional Application Ser. No. 60/331,365, filed January 8, 2002, and of PCT Application Ser. No. PCT/US02/03880, filed on February 8, 2002.

Signed and Sealed this
Ninth Day of August, 2016

Michelle K. Lee

Michelle K. Lee
*Director of the United States Patent and Trademark Office*